US011519121B2

(12) United States Patent
Jang et al.

(10) Patent No.: US 11,519,121 B2
(45) Date of Patent: Dec. 6, 2022

(54) WASHING MACHINE

(71) Applicant: LG Electronics Inc., Seoul (KR)

(72) Inventors: Hosung Jang, Seoul (KR); Yohwan Kang, Seoul (KR); Kwanghyun Kim, Seoul (KR); Hansol Kim, Seoul (KR); Hyunjae Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 524 days.

(21) Appl. No.: 16/455,146

(22) Filed: Jun. 27, 2019

(65) Prior Publication Data

US 2020/0002871 A1 Jan. 2, 2020

(30) Foreign Application Priority Data

Jun. 27, 2018 (KR) ..... 10-2018-0074388
Jun. 27, 2018 (KR) ..... 10-2018-0074389
Jun. 18, 2019 (KR) ..... 10-2019-0072393

(51) Int. Cl.
*D06F 37/26* (2006.01)
*D06F 39/08* (2006.01)

(52) U.S. Cl.
CPC ..... *D06F 37/266* (2013.01); *D06F 39/083* (2013.01); *D06F 37/265* (2013.01); *D06F 39/085* (2013.01)

(58) Field of Classification Search
CPC ..... D06F 37/266; D06F 39/083
See application file for complete search history.

(56) References Cited

U.S. PATENT DOCUMENTS

2011/0083477 A1 4/2011 Kim et al.
2014/0033449 A1* 2/2014 Im ..... D06F 37/266 8/137
2014/0352363 A1 12/2014 Kim

FOREIGN PATENT DOCUMENTS

CN 102121186 7/2011
CN 102575412 7/2012
CN 103547726 1/2014
CN 103774381 5/2014
(Continued)

OTHER PUBLICATIONS

Office Action in Russian Appln. No. 2021101572, dated Jul. 6, 2021, 11 pages (with English translation).
(Continued)

*Primary Examiner* — Joseph L. Perrin
*Assistant Examiner* — Kevin G Lee
(74) *Attorney, Agent, or Firm* — Fish & Richardson P.C.

(57) ABSTRACT

Disclosed is a washing machine including: a gasket, wherein the gasket includes a gasket body, forming a passage between a laundry entry hole formed in a casing and an opening formed in a tub, and a plurality of nozzles spraying water into a drum; and a distribution pipe supplying water pumped by a pump to the plurality of nozzles, wherein the distribution pipe includes a transport conduit disposed on an outer circumferential surface of the gasket, wherein the gasket body is divided into a front body positioned on the side of the casing and a rear body positioned on the side of the tub, wherein the rear body includes an accommodating part in which at least a portion of the transport conduit is disposed, and accordingly, it is possible to prevent intervention between the distribution pipe and any other structure around the gasket.

20 Claims, 18 Drawing Sheets

(56) References Cited

FOREIGN PATENT DOCUMENTS

| | | | | | |
|---|---|---|---|---|---|
| CN | 104204333 | | | 12/2014 | |
| CN | 104233694 | | | 12/2014 | |
| EP | 2719814 | | | 4/2014 | |
| EP | 2808435 | A1 | | 12/2014 | |
| EP | 3483329 | | | 5/2019 | |
| JP | 2009297139 | | | 12/2009 | |
| JP | 2010094227 | A | * | 4/2010 | |
| JP | 2010523195 | | | 7/2010 | |
| JP | 2011139815 | | | 7/2011 | |
| JP | 2011250922 | | | 12/2011 | |
| JP | 2012070810 | | | 4/2012 | |
| JP | 2012070810 | A | * | 4/2012 | |
| JP | 2013085850 | | | 5/2013 | |
| JP | 2014510607 | | | 5/2014 | |
| RU | 2594962 | C2 | | 8/2015 | |
| WO | WO-2014037840 | A1 | * | 3/2014 | ..... D06F 39/088 |
| WO | WO2016136154 | | | 9/2016 | |

OTHER PUBLICATIONS

EP Search Report in European Application No. EP19182880, dated Dec. 17, 2019, 8 pages.
PCT International Search Report in International Application No. PCT/KR2019/007665, dated Oct. 24, 2019, 5 pages.
Office Action in Chinese Appln. No. 201910567099.6, dated Feb. 2, 2022, 10 pages (with English translation).
Office Action in Chinese Appln. No. 201910567099.6, dated Nov. 19, 2021, 14 pages (with English translation).
Office Action in Japanese Appln. No. 2020-572528, dated Feb. 15, 2022, 12 pages (with English translation).

* cited by examiner

WASHING MACHINE

CROSS-REFERENCE TO RELATED APPLICATION

This application claims the priority benefit of Korean Application No. 10-2019-0072393, filed on Jun. 18, 2019, Korean Application No. 10-2018-0074389, filed on Jun. 27, 2018, and Korean Application No. 10-2018-0074388, filed on Jun. 27, 2018. The disclosures of the prior applications are incorporated by reference in their entirety.

BACKGROUND OF THE INVENTION

1. Field of the Invention

The present invention relates to a washing machine and particularly to a washing machine having nozzles that spray water, discharged from a tub and circulated along a circulation pipe, into a drum.

2. Description of the Related Art

In general, a washing machine is an apparatus for removing a contaminant adhered to clothes, bedding, etc. (hereinafter, referred to as 'the laundry') using a chemical disintegration of water and a detergent and a physical operation such as a friction between water and the laundry. The washing machine includes a tub containing water, and a drum rotatably provided in the tub to accommodate laundry.

Korean Patent Application Publication No. 10-2011-0040180 (hereinafter, referred to as a "related art") discloses a washing machine that circulates water, discharged from a tub, using a circulation pump and sprays the circulated water into a drum through a spray nozzle. The washing machine is in a structure in which a distributer is coupled to the circulation pump to distribute wash water and first and second spray paths are connected to the distributer to guide the wash water to first and second spray nozzles, respectively. In addition, the spray nozzles are connected to a gasket by connectors passing through the gasket and are connected to the spray paths.

The related art discloses a washing machine having two spray nozzles, but the washing machine is not capable of uniformly wetting laundry since spray directions are limited. In particular, although various new technologies for controlling rotation of the drum have been developed to provide diversity to movement of laundry loaded in the drum, it is hard to expect remarkable improvement in performance using the conventional structure.

In addition, the conventional technology has a complex structure because the spray nozzles need to be coupled to the gasket by passing the connectors through the gasket, the spray nozzles connected to the circulation pump need to be in number corresponding to the number of spray nozzles, and a plurality of flow paths and the plurality connectors need to be coupled, respectively. In addition, the manufacturing procedure is bothersome due to the assembling process.

In addition, the plurality of spray paths may be interfered with any other structure around the tub, such as a balancer. In order to avoid such interference, the structure and position of the balancer or the like are limited.

In addition, there are many portions for connecting the pump, the spray paths, the connectors, and the spray nozzles, and wash water is likely to leak through the portions. In addition, there is also a hygiene issue because of solidification of detergent in the wash water or pigmentation of a contaminant.

In order to solve the above problem, a method for guiding circulating water, discharged from a circulation pump to a plurality of nozzles is actively under development.

However, there may be intervention between a pipe for guiding the circulating water to the plurality of nozzles and a structure such as a balancer.

In addition, abrasion of the gasket may occur due to friction between the pipe for guiding the circulating water to the plurality of nozzles ad the gasket.

SUMMARY OF THE INVENTION

An object of the present invention is to provide a washing machine having a plurality of nozzles for uniformly spraying water discharged from a tub to thereby uniformly wet laundry, and simplifying a connection structure and an assembling process between a pump and the plurality of nozzles.

Another object of the present invention is to provide a washing machine that avoids intervention between a circulating water supply pipe for guiding water pumped by a pump to nozzles and any other structure around a gasket.

Yet another object of the present invention is to provide a washing machine that prevents the circulating water supply pipe from being separated from the gasket due to deformation of the gasket that can be caused by vibration of the tub upon rotation of a drum.

Yet another object of the present invention is to provide a washing machine that prevents abrasion of a basket due to friction between the circulating water supply pipe and the gasket.

Objects of the present invention should not be limited to the aforementioned objects and other unmentioned objects will be clearly understood by those skilled in the art from the following description.

In order to achieve the above objects, a washing machine according to an embodiment of the present invention includes: a gasket, wherein the gasket includes a gasket body, forming a passage between a laundry entry hole formed in a casing and an opening formed in a tub, and a plurality of nozzles spraying water into a drum; and a distribution pipe supplying water pumped by a pump to the plurality of nozzles.

The laundry entry hole is formed in a front surface of the casing.

The tub is disposed in the casing. The opening is formed in a front surface of the tub.

The plurality of nozzles is provided on an inner circumferential surface of the gasket body.

The distribution pipe includes a transport conduit disposed on an outer circumferential surface of the gasket, and a plurality of outlet ports protruding from the transport conduit toward the gasket body. The transport conduit guides water pumped by the pump. The plurality of outlet ports supplies water to the plurality of nozzles.

The gasket body is divided into a front body positioned on the side of the casing and a rear body positioned on the side of the tub.

The transport conduit is disposed in the rear body. The rear body comprises an accommodating part in which at least a portion of the transport conduit is disposed.

The accommodating part includes a boundary surface bent from a rear end of the front body to extend inward, and a seating surface bent from an inner end of the boundary surface to extend rearward and opposing the transport conduit. The seating surface opposes the transport conduit.

The gasket body may include a rim part extending from the casing toward the tub, an inner circumferential part bent outward from the rim part to extend toward the casing, and an outer circumferential part bent outward from the inner circumferential part to extend toward the tub.

The outer circumferential part may have a diameter greater than a diameter of the inner circumferential part.

The rear body may be disposed in the outer circumferential part.

The boundary surface may be disposed at a rear side further than a portion bent from the rim part of the inner circumferential part.

The seating surface may be disposed at an outer side than a portion bent from the rim part of the inner circumferential part.

The transport conduit may include an inner surface that opposes the outer circumferential surface of the gasket body. An inner surface of at least a portion of the transport conduit may be disposed between the seating surface and a virtual plane that extends rearward from a rear end of the front body.

When the gasket body is bilaterally divided into a first area and a second area, the accommodating part includes a first accommodating part disposed in the first area, and a second accommodating part disposed in the second area.

The gasket may include a plurality of port receiving pipes protruding from the outer circumferential surface of the gasket body and communicating with the plurality of nozzles, respectively.

The plurality of port receiving pipes may include a first upper port receiving pipe and a first lower port receiving pipe that are vertically disposed in the first area.

The first lower port receiving pipe may be disposed lower than a horizontal line that passes through a center of the gasket.

The first upper port receiving pipe may be disposed higher than the horizontal line.

A distance between the first lower port receiving pipe and the horizontal line may be shorter than a distance between the first upper port receiving pipe and the horizontal line.

The first accommodating part may extend from above at least the horizontal line to below the first lower port receiving pipe along a circumferential direction of the gasket.

The first lower port receiving pipe may protrude from the seating surface of the first accommodating part.

The first lower port receiving pipe and the first upper port receiving pipe may protrude in directions parallel to each other.

The first lower outlet port and the first upper outlet port may protrude in directions parallel to each other.

The plurality of port receiving pipes may comprise a second upper port receiving pipe and a second lower port receiving pipe that are vertically disposed in the second area.

The plurality of outlet ports may include a second upper outlet port coupled to the second upper port receiving pipe, and a second lower outlet port coupled to the second lower port receiving pipe.

The distribution pipe may include an inlet port protruding downward from the transport conduit at a point lower than the first and second lower outlet ports and introducing water pumped by the pump.

The transport conduit may include: a first conduit part disposed on an outer circumferential surface of the first area, and guiding water, introduced through the inlet port, to the first lower outlet port and the first upper outlet port, sequentially; and a second conduit part disposed on an outer circumferential surface of the second area, and guiding water, introduced through the inlet port, to the second lower outlet port and the second upper outlet port, sequentially.

The washing machine may further include a balancer disposed at the front surface of the tub. The balancer may include a first balancer disposed at an outer side of the first area and a second balancer disposed at an outer side of the second area.

At least a portion of the transport conduit may be disposed between the gasket and the balancer. At least a portion of the first conduit part may be disposed between the seating surface of the first accommodating part and the first balancer. At least a portion of the second conduit part may be disposed between the seating surface of the second accommodating part and the second balancer.

The distribution pipe may include: a first distribution pipe supplying water, pumped by the pump, to a first upper nozzle and a first lower nozzle that communicate with the first upper port receiving pipe and the first lower port receiving pipe, respectively; and a second distribution pipe supplying water, pumped by the pump, to a second upper nozzle and a second lower nozzle that communicating with the second upper port receiving pipe and the second lower port receiving pipe, respectively.

The first distribution pipe may include a first transport conduit disposed on the outer circumferential surface of the first area, and a first inlet port introducing water pumped by the pump and disposed below the first lower outlet port to protrude from the first transport conduit, and the first upper and lower outlet ports.

The second distribution pipe may include a second transport conduit disposed on the outer circumferential surface of the second area, a second inlet port introducing water pumped by the pump and disposed below the second lower outlet port to protrude from the second transport conduit, and the second upper and lower outlet ports.

The transport conduit may be formed to have a width in a front-rear direction that is greater than a width in a radial direction.

A width of the recessed portion in the front-back direction may be equal to or greater than the width of the transport conduit in the front-back direction.

The gasket may include a rib protruding from the accommodating part toward the transport conduit.

The rib may protrude at least one of the seating surface or the boundary surface.

The rib may include a first protrusion protruding from the seating surface in a radial direction of the gasket body, and a second protrusion protruding from the boundary surface toward the tub. The rib may include a connecting protrusion formed between the first protrusion and the second protrusion. The connecting protrusion may connect the first protrusion and the second protrusion.

The rib may include a plurality of ribs.

The plurality of ribs may be spaced apart in a circumferential direction of the gasket body.

The rib may be disposed between the lower port receiving pipe and the upper port receiving pipe.

The details of other embodiments are included in the following description and the accompanying drawings The washing machine of the present invention may have one or more effects, as below.

First, a plurality of nozzles is provided on an inner circumferential surface of a gasket, and a distribution pipe connects the pump and the plurality of nozzles so as to supply water pumped by the pump to the plurality of nozzles, and thus, there is an advantageous effect of simplifying a connection structure and an assembling process between the pump and the plurality of nozzles.

Second, the rear body of the gasket body includes an accommodating part, which includes a boundary surface bent from a rear end of the front body to extend inward and a seating surface bent from an inner end of the boundary surface to extend rearward and opposing the transport conduit, and at least a portion of the transport conduit of the distribution pipe is disposed in the accommodating part, and therefore, it is possible to avoid intervention between the distribution pipe and any other structure around the gasket, such as the balancer. In addition, as the intervention between the distribution pipe and other structures, the whole washing machine may be reduced in size.

Third, the gasket may include a rim part extending from the casing toward the tub, an inner circumferential part bent outward from the rim part to extend toward the casing, and an outer circumferential part bent outward from the inner circumferential part to extend toward the tub. A shape of the inner circumferential surface may change repeatedly due to vibration of the tub upon rotation of the drum. Since the accommodating part is disposed on the outer circumferential surface, it is possible to smoothly spray water into the drum through the nozzles and prevent separation the distribution pipe due to deformation of the gasket.

Fourth, the gasket includes a rib protruding from the accommodating part toward the transport conduit, and thus, it is possible to prevent abrasion of the gasket due to friction between the distribution pipe and the gasket.

Effects of the present invention should not be limited to the aforementioned effects and other unmentioned effects will be clearly understood by those skilled in the art from the claims.

BRIEF DESCRIPTION OF THE DRAWINGS

The embodiments will be described in detail with reference to the following drawings in which like reference numerals refer to like elements wherein.

DETAILED DESCRIPTION OF THE PREFERRED EMBODIMENTS

Figure 1:
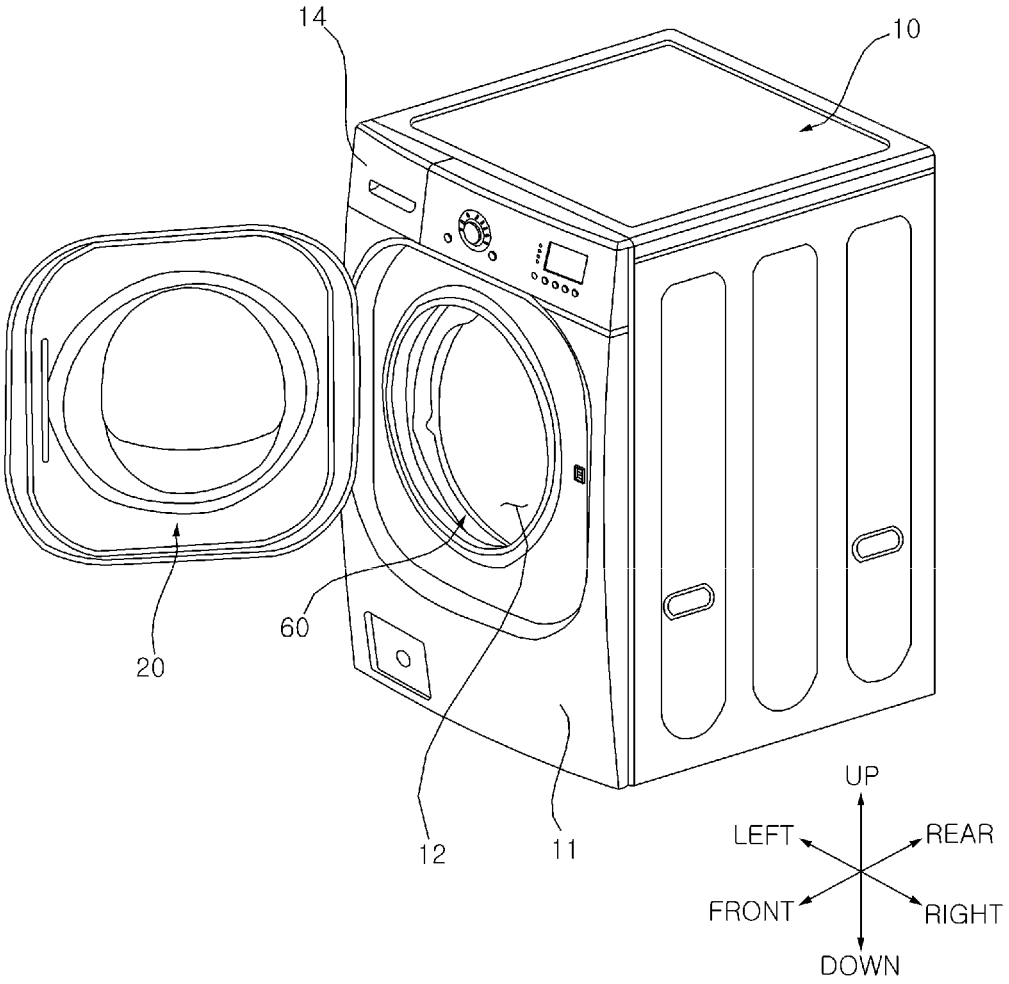
FIG. 1 is a perspective view of a washing machine according to an embodiment of the present invention.

Advantages and features of the present disclosure and methods to achieve them will become apparent from the descriptions of exemplary embodiments herein below with reference to the accompanying drawings. However, the present disclosure is not limited to exemplary embodiments disclosed herein but may be implemented in various different ways. The exemplary embodiments are provided for making the disclosure of the present disclosure thorough and for fully conveying the scope of the present disclosure to those skilled in the art. It is to be noted that the scope of the present disclosure is defined only by the claims. Like reference numerals denote like elements throughout the descriptions.

Hereinafter, the present invention will be described in detail with reference to the accompanying drawings.

Figure 2:
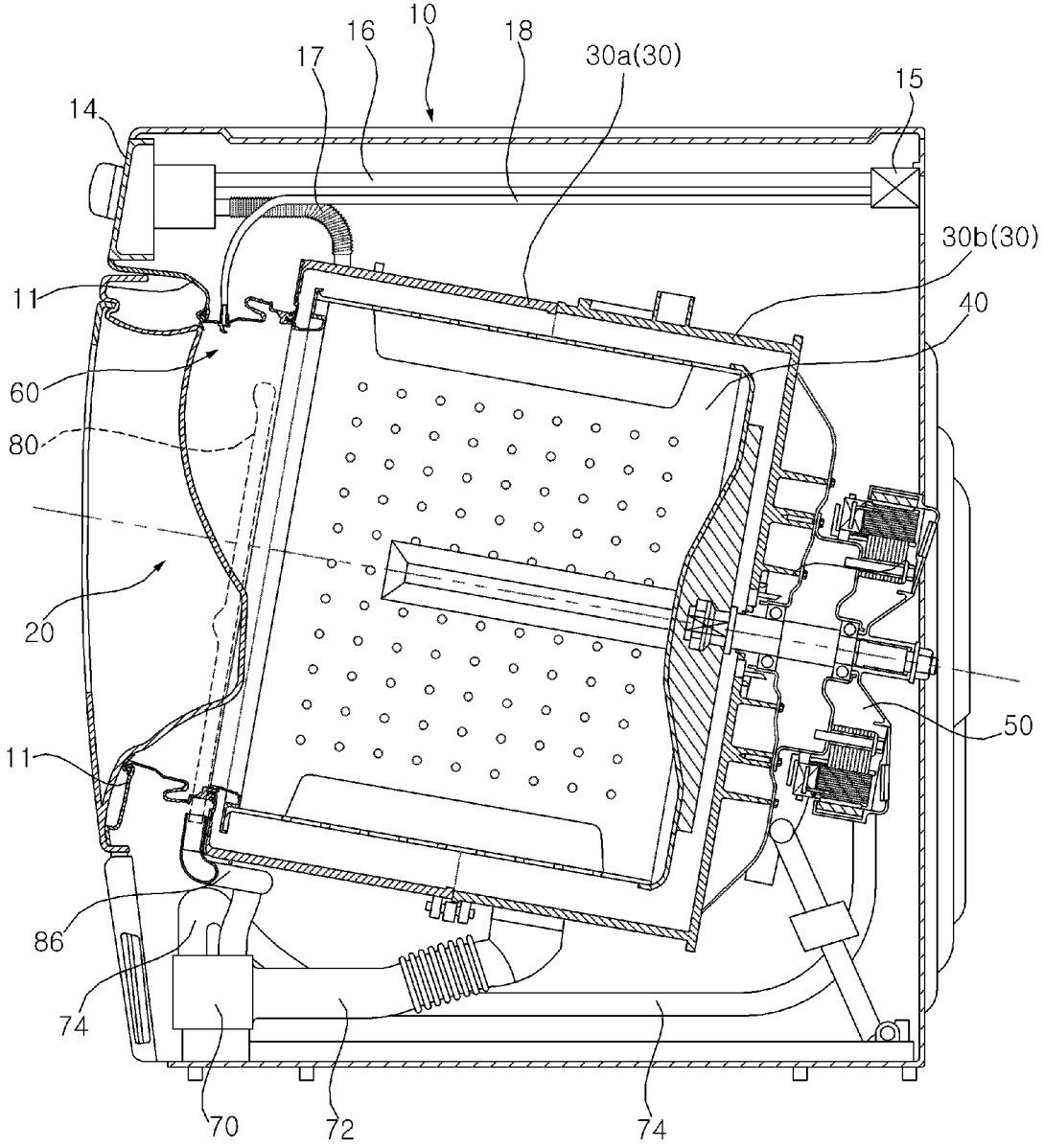
FIG. 2 is a cross-sectional view of the washing machine shown in FIG. 1.

Referring to FIGS. 1 and 2, a washing machine according to the present invention includes a casing 10 forming an exterior appearance of the washing machine, a tub 30 for containing wash water, and a drum 40 rotatably provided in the tub 30 and accommodating laundry. In addition, the washing machine may include a motor (hereinafter, referred to as a "driving unit") for rotating the drum 40.

A front panel 11 having a laundry entry hole 12 formed therein is disposed on a front surface of the casing 10. A door 20 for opening and closing the laundry entry hole 12 is disposed on the front panel 11, and a dispenser 14 for supplying detergent may be installed on the front panel 11.

In addition, a water supply valve 15, a water supply pipe 16, and a water supply hose 17 are installed in the casing 10 so that wash water supplied after passing through the water supply valve 15 and the water supply pipe 16 is mixed with detergent in the dispenser 14 and is then supplied to the tub 30 through the water supply hose 17.

Meanwhile, a direct water supply pipe 18 may be connected to the water supply valve 15 so that wash water is supplied directly to the tub 30 through the direct water supply pipe 18 without being mixed with detergent.

In addition, a pump 70 and a distribution pipe 80 may be installed. The pump 70 and the tub 30 may be connected via a discharge hose 72, and the distribution pipe 80 and the pump 70 may be connected directly to each other or connected via a circulation pipe 86. Accordingly, if the pump 70 operates, wash water contained in the tub 30 may be sprayed into the drum 40 through the distribution pipe 80 and circulate. The pump 70 may be connected to a drain pipe 74 and discharge wash water to the outside through the drain pipe 74.

As described above, the pump 70 of the washing machine according to an embodiment of the present invention functions a drain pump for discharging wash water to the outside and as a circulation pump for circulating wash water. On the contrary, a drain pump and a circulation pump may be installed individually, and, in this case, it is obvious that the drain pump is connected to the drain pipe 74 and the circulation pump is connected to the circulation pipe 86.

Meanwhile, the tub 30 may be formed as a single tub body or may be formed as a combination of a first tub body 30*a* and a second tub body 30*b* coupled thereto. In the embodiment of the present invention, an example in which the first tub body 30*a* and the second tub body 30*b* are coupled to form the tub 30 is described. Hereinafter, the first tub body 30*a* is referred to as a "tub" 30.

The tub 30 is disposed in the casing 10, and an opening 32 (see FIG. 4) is formed at the front of the tub 30 to correspond to the laundry entry hole 12 formed in the front panel 11.

The drum 40 for accommodating laundry may be rotatably provided in the tub 30. The drum 40 receives laundry, and is disposed such that an entrance hole through which laundry is loaded is disposed at a front surface. The drum 40 is rotated about an approximately horizontal rotation center line. In this case, "horizontal" does not refer to the mathematical definition thereof. That is, even in the case where the rotation center line is inclined at a predetermined angle relative to a horizontal state, the axis is more like in the horizontal state than in a vertical state, and thus, it is considered that the rotation center line is substantially horizontal. A plurality of through holes may be formed in the drum 40 so as to introduce water contained in the tub 30 into the drum 40.

A plurality of lifter may be provided on an inner surface of the drum 40. The plurality of liters may be disposed at a predetermined angle relative to the center of the drum 40. When the drum 40 is rotated, laundry repeatedly goes through an operation of being lifted by the lifter and falling.

A driving unit 50 for rotating the drum 40 may be further provided. A driving shaft to be rotated by the driving unit 50 may penetrate the rear of the tub 30 to be coupled to the drum 40.

Preferably, the driving unit 50 includes a direct drive wash motor, and the wash motor may include a stator fixed to the rear of the tub 30, and a rotor rotating by a magnetic force acting in relation with the stator. The driving shaft 38*a* may rotate integrally with the rotor.

Figure 3:
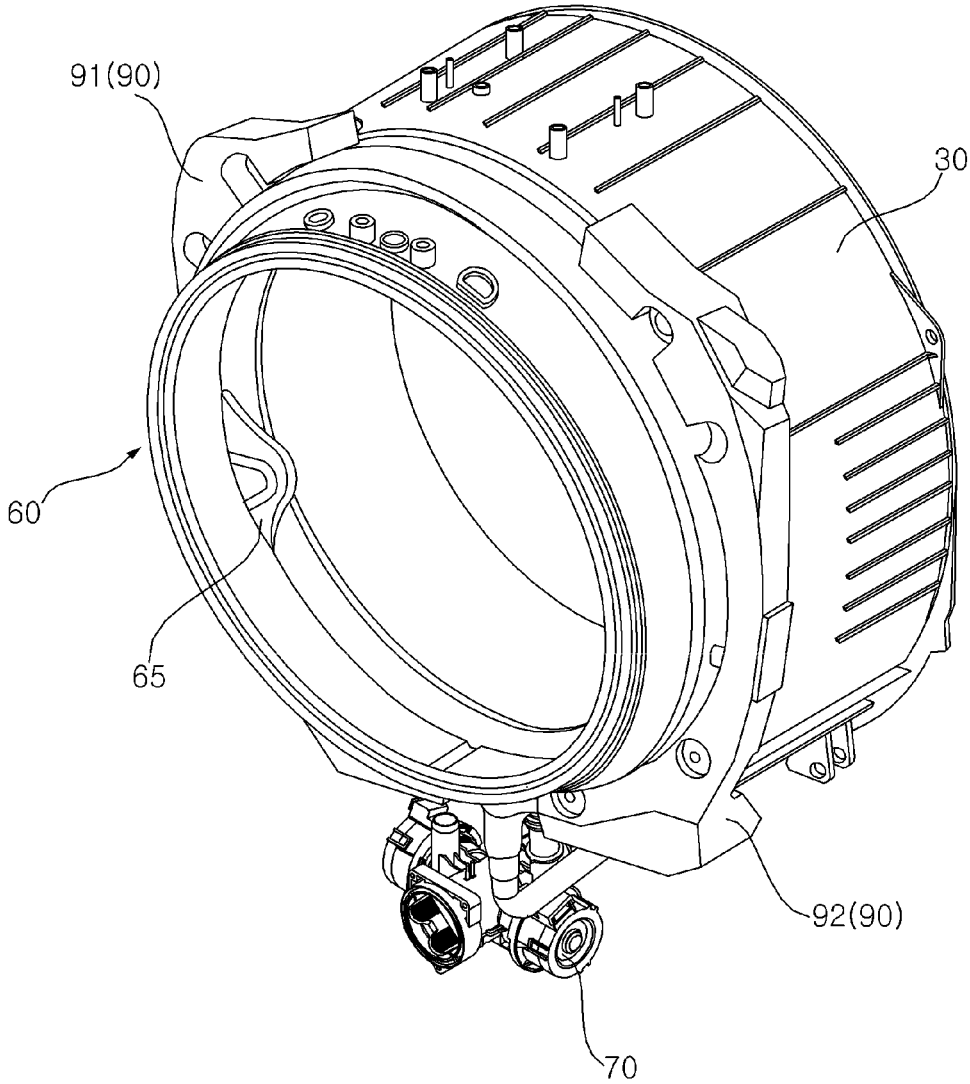
FIG. 3 illustrates a portion of a washing machine according to a first embodiment of the present invention.
Figure 4:
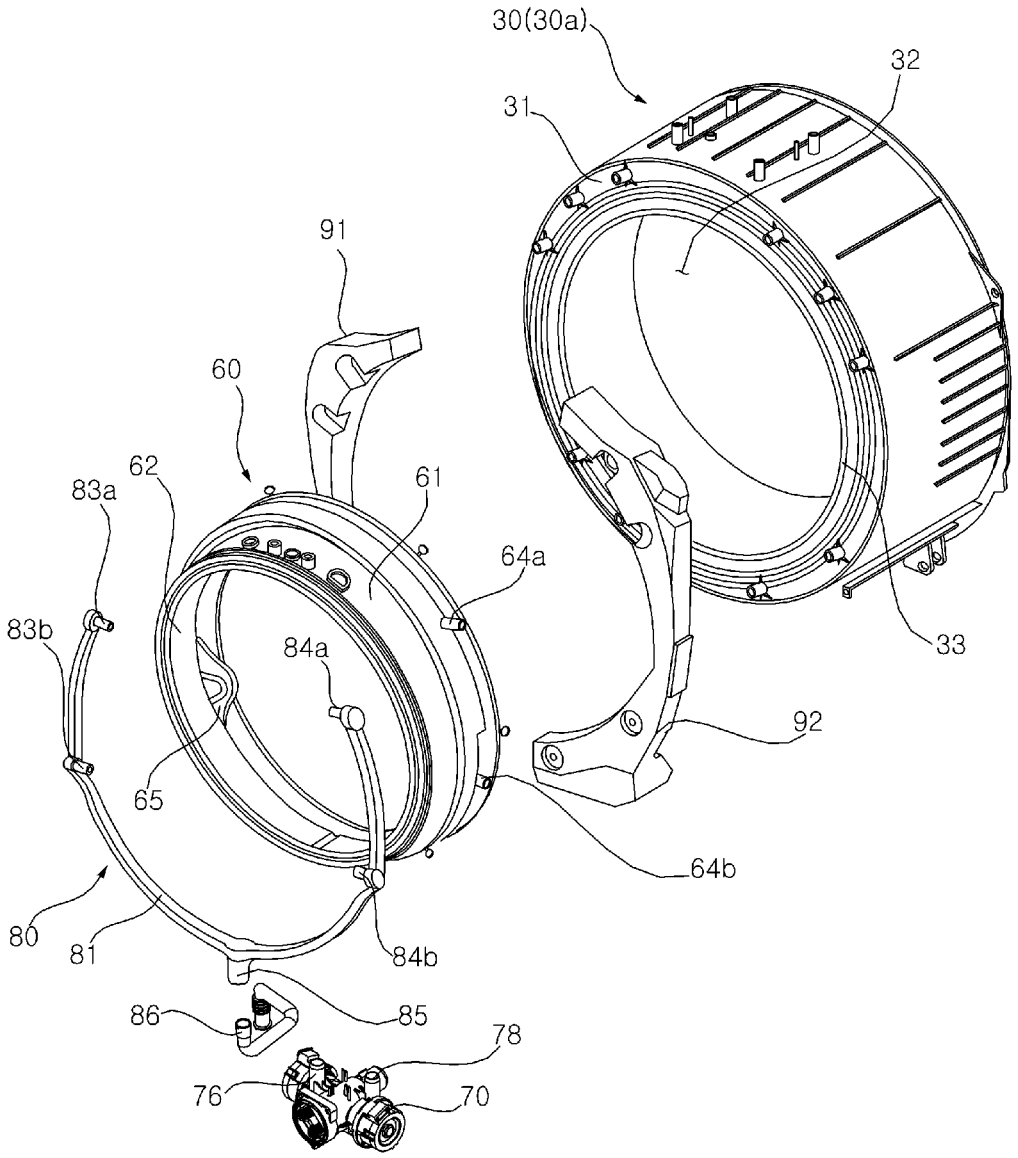
FIG. 4 is an exploded perspective view of an assembly shown in FIG. 3.

Referring to FIGS. 3 and 4, the washing machine according to an embodiment of the present invention includes a gasket 60 for connecting the casing 10 and the tub 30, a plurality nozzle 66 and 67 (see FIG. 6) for spraying water into the drum 40, the pump 70 for pumping water discharged from the tub 30, and a distribution pipe 80 for guiding the water pumped by the pump 70 to the nozzle 66 and 67. In addition, the washing machine may include a balancer 90 disposed at a front surface 31 of the tub 30, and the circulation pipe 86 for guiding the water pumped by the pump 70 to the distribution pipe 80.

Referring to FIGS. 2, 3, 4, 5, and 8, the gasket 60 includes a gasket body 61 and 62 that forms a passage 60P connecting the laundry entry hole 12 of the casing 10 and the opening 32 of the tub 30. An inner circumferential surface facing the central direction of the gasket body 61 and 62 of the gasket 60 may be referred to as an inner circumferential surface 62, and an outer circumferential surface opposite thereto may be referred to the inner circumferential surface 61.

The inner circumferential surface 62 of the gasket body may form the passage 60P connecting the laundry entry hole 12 and the opening 32. The outer circumferential surface 61 of the gasket body may oppose the inner circumferential surface of the balancer 90. The outer circumferential surface of the gasket body of the gasket 60 may oppose the distribution pipe 80.

The gasket 60 is disposed between an edge defining the entry hole 12 of the front panel 11 and an edge defining the opening 32 of the tub 30, and accordingly, a leakage of wash water contained in the tub 30 is prevented.

More specifically, the gasket 60 is formed of a flexible substance such as rubber and has an approximate cylindrical shape (hereinafter, referred to as an annular shape). For example, the gasket 60 may be formed of a substance such as Ethylene Propylene Diene Monomer (EPDM), Thermo Plastic Elastomer (TPE), or the like, but aspects of the present invention are not limited thereto.

As the front boundary of the gasket 60 is connected to the edge of the entry hole 12 of the front panel 11, and the rear boundary of the gasket 60 is connected to the edge of the opening 32 of the tub 30, the gasket body 61 and 62 connecting the front and rear boundaries of the gasket 60 forms the laundry entry passage 60P. If a space between the tub and the front panel are sealed and the door 20 is closed, the door 20 and the front end of the gasket 60 are tightly brought into contact with each other and the space between the door 20 and the gasket 60 is sealed, and therefore, leakage of wash water is prevented.

A front end part and a rear end part of the gasket 60 are annular, and the gasket 60 has a tubular shape extending from the front end part to the rear end part. The front end part of the gasket 60 is fixed to the casing 10, and the rear end part is fixed to an entrance hole circumference 33 of the tub 30. The gasket 60 may be formed of a flexible or elastic substance. The gasket 60 may be formed of natural rubber or synthetic resin.

The gasket 60 may include a casing coupling part 68*a* coupled to a circumference of the entry hole 12 of the casing 10, a tub coupling part 68*b* coupled to a circumference of the entrance hole circumference 33 of the tub 30, and a gasket body 61 and 62 extending between the casing coupling part 68*a* and the tub coupling part 68*b*.

The casing coupling part 68*a* and the tub coupling part 68*b* have an annular shape. The gasket body 61 and 62 may include an annular front end part connected to the casing coupling part 68*a* and an annular rear end part connected to the tub coupling part 68*b*, and have a tubular shape extending from the front end part to the rear end part.

The circumference of the entry hole 12 of the front panel 11 is rolled outwardly, and the casing coupling part 68 may be fitted into a concave area formed by the outward rolled portion.

An annular groove to be wound by a wire may be formed in the casing coupling part 61. After the wire winds around the groove 61*r*, both ends of the wire are bound, and therefore, the casing coupling part 61 is tightly fixed to the circumference of the entrance hole 12*h*.

The entrance hole circumference 33 of the tub 30, which defines the opening 32 of the tub 30, protrudes from the front surface 31 and is rolled outward, and the tub coupling part 68*b* is fitted in a concave area formed by the outward rolled portion. An annular groove to be wound by a wire may be formed in the tub coupling part 68*b*. The wire winds around the groove, and both ends of the wire are bounded, and accordingly, the tub coupling part 68*b* may be tightly coupled to the entrance hole circumference 33 of the tub 30.

While the casing coupling part 68*a* is fixed to the front panel 11, the tub coupling part 68*b* is displaceable in accordance with movement of the tub 30. Accordingly, the gasket body 61 and 62 needs to be able to transform in accordance with the displacement of the tub coupling part 68*b*. In order to allow the gasket body to transform easily, the gasket 60 may include a folding part 61*b* between the casing coupling part 68*a* and the tub coupling part 68*b* (or the gasket body 61 and 62), and the folding part 61*b* (hereinafter, referred to as an "inner circumferential part") is folded as the tub 30 moves in a direction of eccentricity (or a radial direction).

The gasket body 61 and 62 may include: an annular rim part 61*a* extending from the casing 10 (or the casing coupling part 68*a*) toward the tub 30 (or the tub coupling part 68*b*) (or toward the rear); an inner circumferential part 61*b* bent outward from the first flat part 61*a* and extending toward the casing 10; and an outer circumferential part bent outward from the inner circumferential part 61*b*, extending toward the tub 30, and having a diameter greater than a diameter of the rim part 61 and a diameter of the inner circumferential part 61*b*.

The gasket 60 may include an outer door contact portion 683 that is bent from the front of the gasket body 61 and 62 toward an outer side, so that the outer door contact portion 683 can be brought into a rear surface of the door 20 in the outside of the entry hole 12 in a state in which the door 20 is closed. The casing coupling part 68*a* may have the aforementioned groove that is formed at a portion extending from the outer side of the outer door contact portion 683.

The gasket 60 may further include an inner door contact portion 681 that is bent inward from the front of the gasket body 61 and 62*k*, so that the inner door contact portion 681 can be brought into contact with a rear surface (preferably, the window 22) of the door 20 in the inside of the entry hole 12 in a state in which the door 20 is closed.

Meanwhile, during rotation, the drum 40 vibrates (that is, a rotation central line of the drum (see FIG. 2) moves). Accordingly, a central line of the tub 30 (which is approximately identical to the rotation center line of the drum 40) moves as well. In this case, a moving direction (hereinafter, referred to as an "eccentric direction") has a radial directional component.

The front side of the inner circumferential part 61*b* and the front side of the outer circumferential part 61*c* may be folded or unfolded when the tub 30 moves in an eccentric direction. If a portion of the inner circumferential part 61*b* is folded when the center of the tub 30 moves in the eccentric direction, a distance between the inner circumferential part 61*b* and the outer circumferential part 61*c* is reduced at the folded portion, whilst a distance the inner circumferential part 61*b* and the outer circumferential part 61*c* is increased at an unfolded portion of the inner circumferential part 61*b*.

Figure 6:
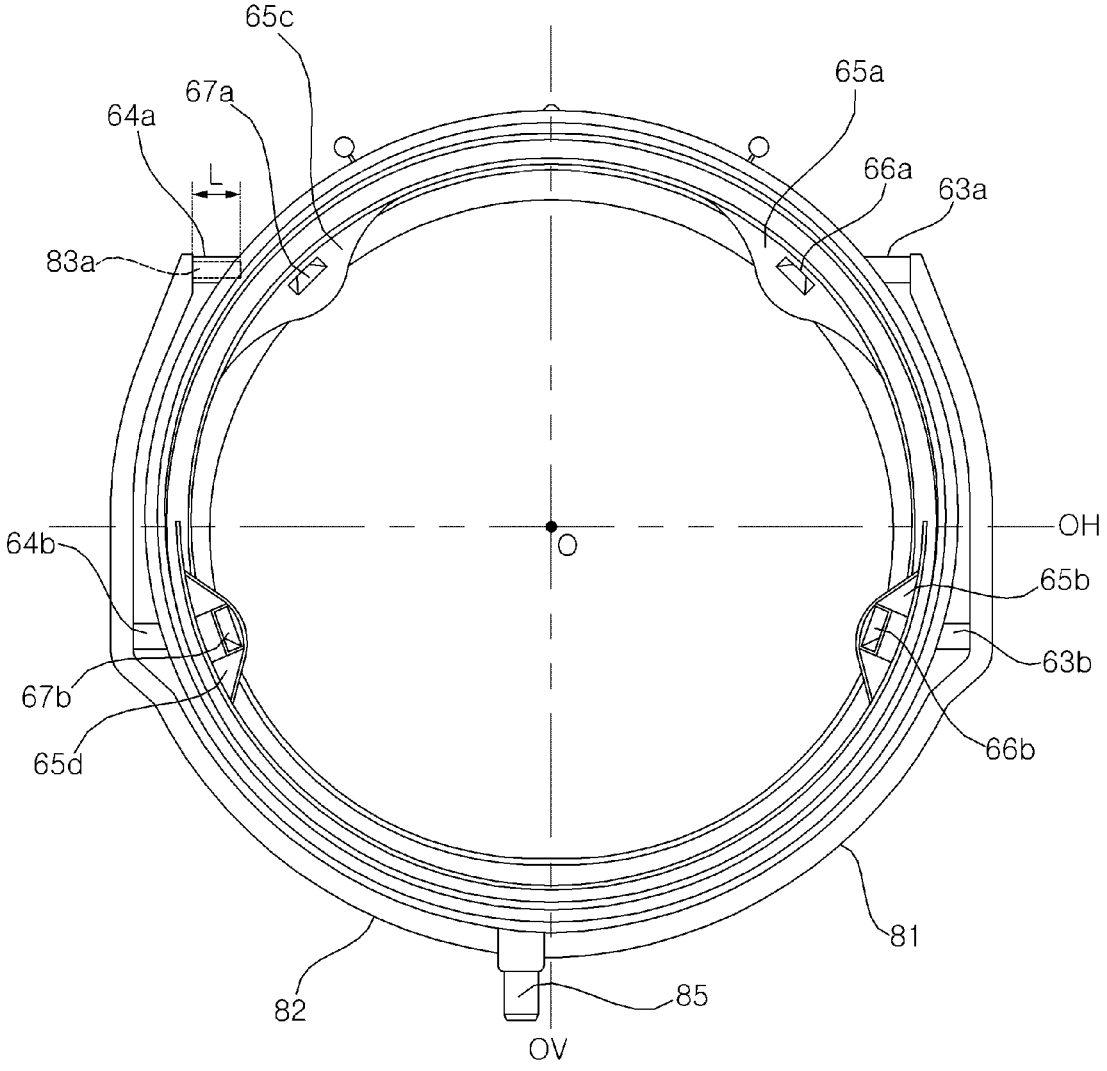
FIG. 6 is a rear view of an assembly including the gasket and a distribution pipe shown in FIG. 4.
Figure 7:
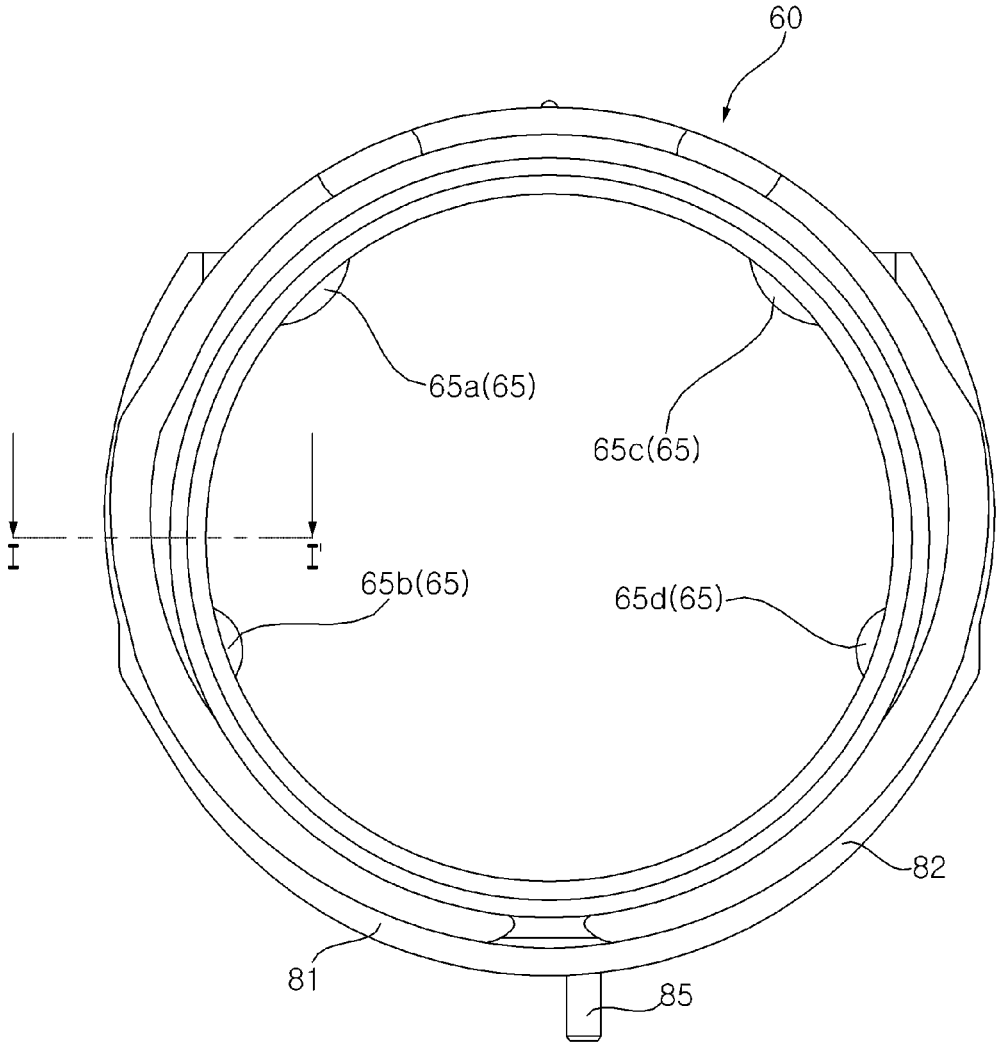
FIG. 7 is a front view of the assembly shown in FIG. 6.
Figure 8:
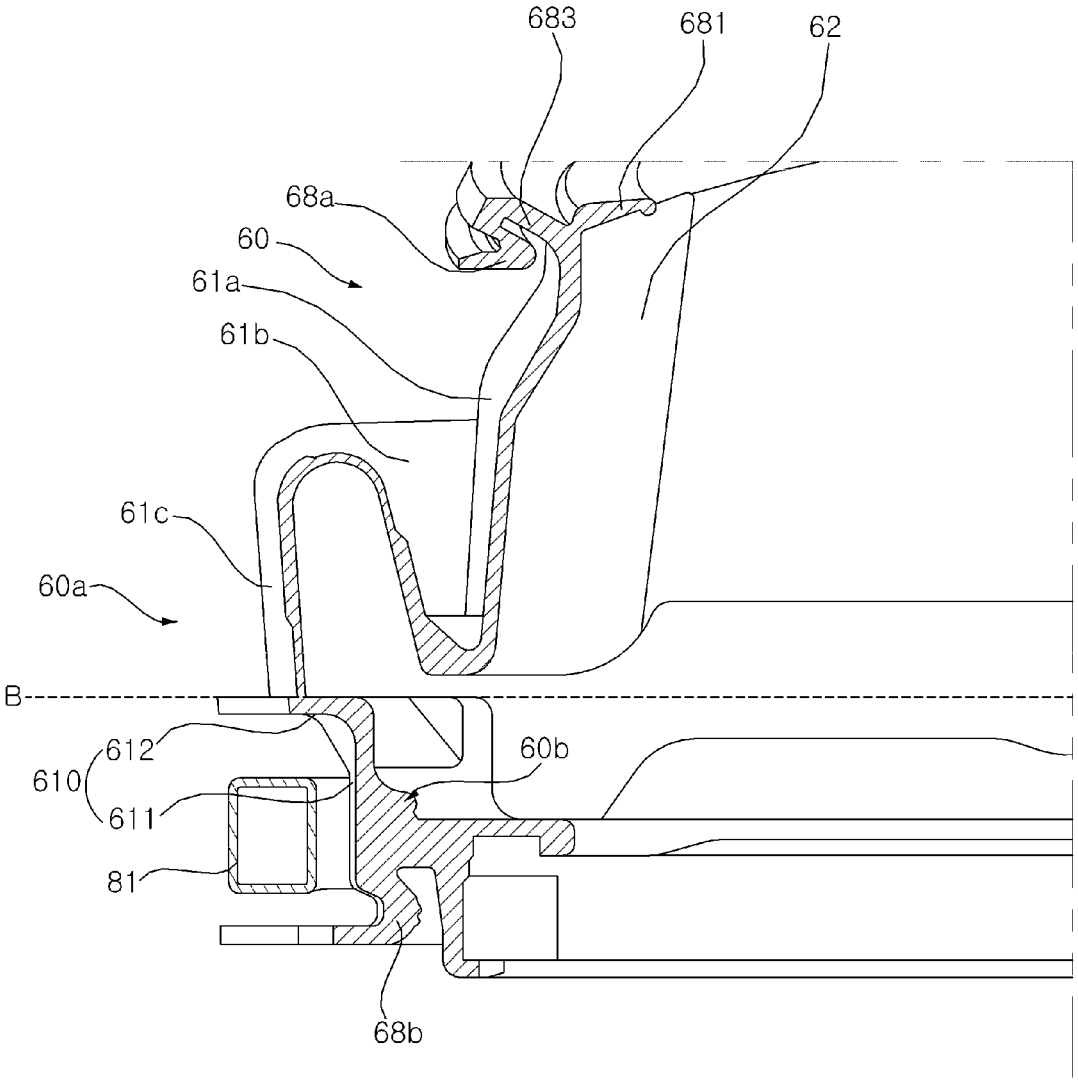
FIG. 8 is a cross-sectional view taken along line I-I in FIG. 7.
Figure 9:
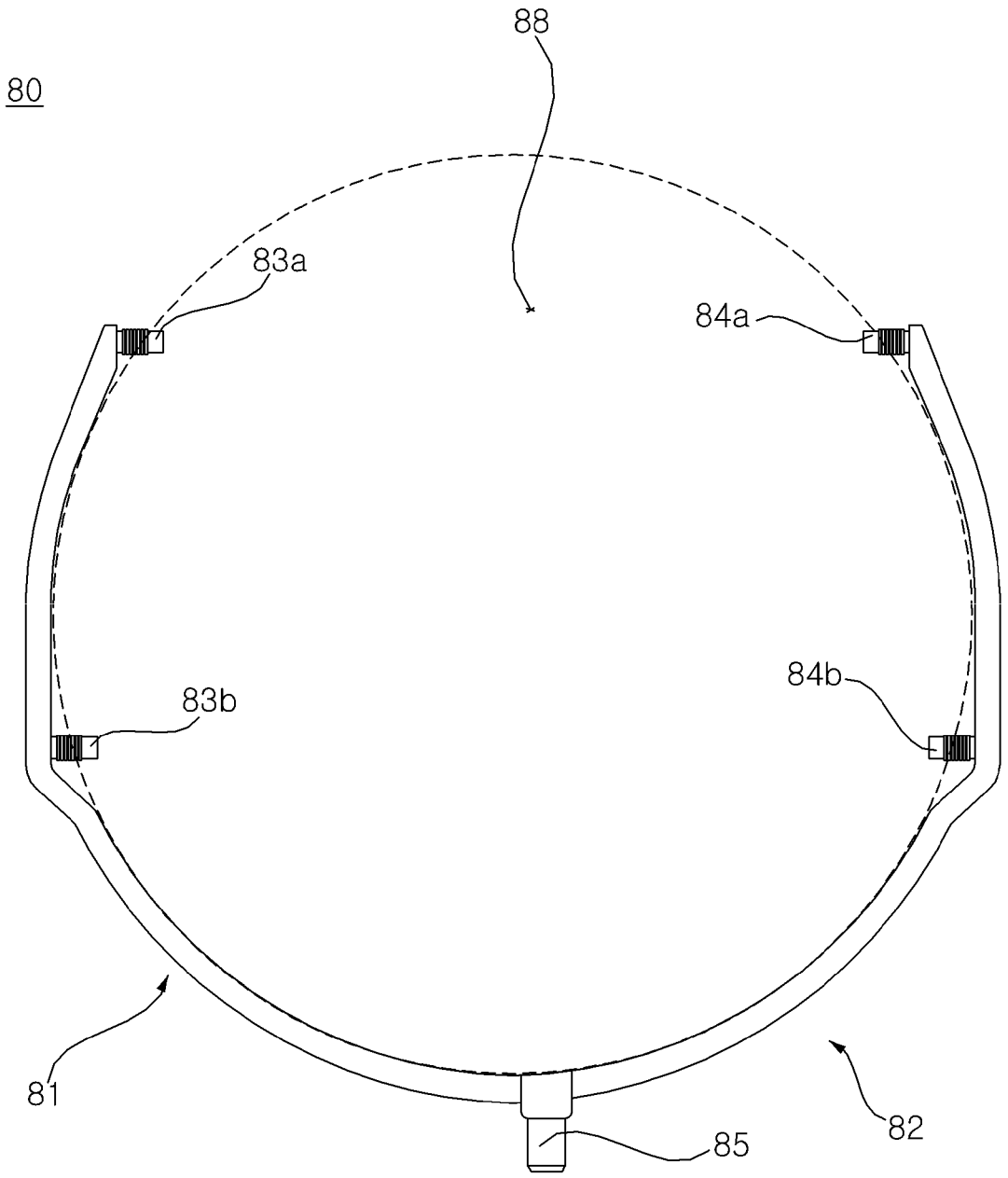
FIG. 9 is a front view of the distribution pipe shown in FIG. 4.

Referring to FIGS. 6 and 7, the plurality of nozzle 66 and 67 may be provided in plural on the inner circumferential surface 62 of the gasket 60. The plurality of nozzles 66 and 67 may include a plurality of upper nozzles 66*a* and 67*a*, and a plurality of lower nozzles 66*b* and 67*b* disposed lower than the upper nozzles 66*a* and 67*a*. The plurality of upper nozzles 66*a* and 67*a* may be disposed higher than the center of the gasket 60, and the plurality of lower nozzles 66*b* and 67*b* may be disposed lower than the center of the gasket 60.

In the case where the gasket body 61 and 62 is bilaterally divided into a first area and a second area, a plurality of nozzles 66 and 67 may include a first nozzle 66 disposed in the first area and a second nozzle 67 disposed in the second area. The first nozzle 66 may be disposed on the left side of the inner circumferential surface 62 of the gasket body, and the second nozzle 67 may be disposed on the right side of the inner circumferential surface 62 of the gasket body.

Each of the first nozzle 66 and the second nozzle 67 may be provided in plural. In the embodiment of the present invention, two first nozzles 66 and two second nozzles 67 are provided, but aspects of the present invention are not limited thereto.

The first nozzle 66 may include a first upper nozzle 66*a* and a first lower nozzle 66*b* that are vertically disposed in the first area. The first lower nozzle 66*b* may be disposed lower than the center O of the gasket 60, and the first upper nozzle 66*a* may be disposed higher than the first lower nozzle 66*b*. The first upper nozzle 66*a* may be disposed higher than the center O of the gasket 60.

The second nozzle 67 may include a second upper nozzle 67*a* ad a second lower nozzle 67*b* that are vertically disposed in the second area. The second lower nozzle 67*b* may be disposed lower than the center O of the gasket 60, and the second upper nozzle 67*a* may be disposed higher than the second lower nozzle 67*b*. The second upper nozzle 67*a* may be disposed higher than the center O of the gasket 60.

The first and second lower nozzles 66*b* and 67*b* may spray circulating water into the drum 40 in an upward direction. The first and second upper nozzles 66*a* and 67*a* may spray circulating water into the drum 40 in a downward direction. The circulating water refers to water that is discharged from the tub 30, pumped by the pump 70, guided to the distribution pipe 80, and sprayed into the drum 40 through the nozzle 66 and 67.

In the gasket 60, there may be provided a direct nozzle for spraying water into the drum 40, and a direct water supply pipe 18 for guiding water supplied through a water supply unit to the direct nozzle. The direct nozzle may be a whirl nozzle or a spray nozzle, but aspects of the present invention are not necessarily limited thereto. When viewed from the front, the direct nozzle may be disposed on a vertical line OV. A window 22 may protrude toward the drum 40 further than the direct nozzle. A water stream sprayed through the direct nozzle may touch the window 22, and, in this case, the effect of cleaning the window 22 may be achieved.

Figure 5:
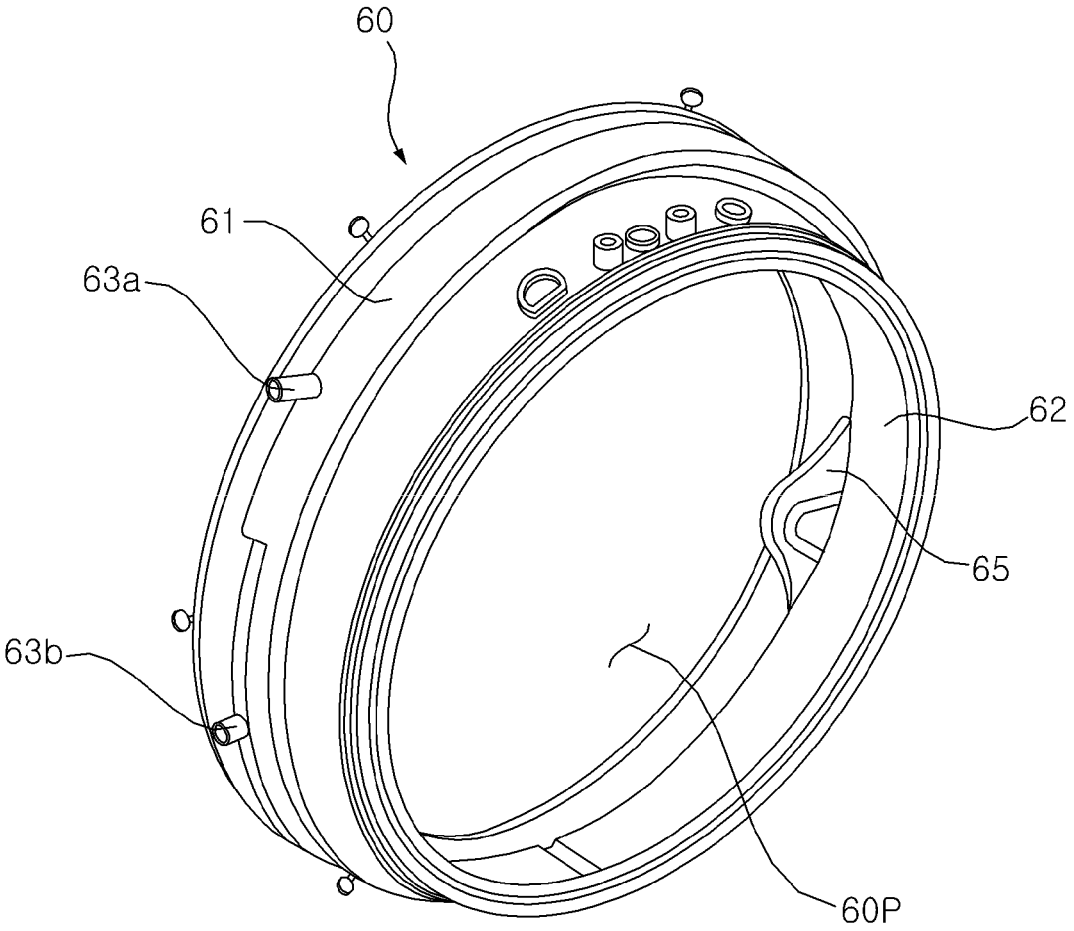
FIG. 5 is a perspective view of a gasket shown in FIG. 4.

Referring to FIGS. 5 and 6, the gasket 60 includes a plurality of port receiving pipes 63 and 64 communicating with the nozzle 66 and 67. The plurality of port receiving pipes 63 and 64 may be formed to protrude from the outer circumferential surface 61 of the gasket body. A plurality of outlet ports 83 and 84 described in the following are inserted into the plurality of port receiving pipes 63 and 64, and the plurality of port receiving pipes 63 and 64 is formed to protrude from the outer circumferential surface 61 of the gasket body, and accordingly, water supplied from the distribution pipe 80 to the plurality of nozzles 66 and 67 is prevented from leaking through between the plurality of port receiving pipes 62 and 63 and the plurality of outlet ports 83 and 84.

The plurality of port receiving pipes 63 and 64 may be in number corresponding to the number of the nozzles 66 and 67. In the case where the gasket body 61 and 62 is bilaterally divided into the first area and the second area, the plurality of port receiving pipes 63 and 64 may include a first port receiving pipe 63 disposed in the first area and a second port receiving pipe 64 disposed in the second area.

The first port receiving pipe 63 may communicate with the first nozzle 66, and the second port receiving pipe 64 may communicate with the second nozzle 67. The first port receiving pipe 63 may be disposed on the left side of the outer circumferential surface 61 of the gasket body, and the second port receiving pipe 64 may be disposed on the right side of the outer circumferential surface of the gasket body.

The first port receiving pipe 63 may include a first upper port receiving pipe 63*a* and a first lower port receiving pipe 63*b* that are vertically disposed in the first area. The first lower port receiving pipe 63*b* is disposed lower than the center O of the gasket 60, and the first upper port receiving pipe 63*a* may be disposed higher than the first lower port receiving pipe 63*b*. The first upper port receiving pipe 63*a* may be disposed higher than the center O of the gasket 60.

The first lower port receiving pipe 63*b* communicates with the first lower nozzle 66*b*, and the first upper port receiving pipe 63*a* communicate with the first upper nozzle 66*a*. The first upper port receiving pipe 63*a* and the first lower port receiving pipe 63*b* may protrude in directions parallel to each other.

The second port receiving pipe 64 may include a second upper port receiving pipe 64*a* and a second lower port receiving pipe 64*b* that are vertically disposed in the second area. The second lower port receiving pipe 64*b* is disposed lower than the center O of the gasket 60, and the second upper port receiving pipe 64*a* may be disposed higher than the second lower port receiving pipe 64*b*. The second upper port receiving pipe 64*a* may be disposed higher than the center O of the gasket 60.

The second lower port receiving pipe 64*b* communicates with the second lower nozzle 67*b*, and the second upper port receiving pipe 64*a* communicates with the second upper nozzle 67*a*. The second upper port receiving pipe 64*a* and the second lower port receiving pipe 64*b* may protrude in directions parallel to each other.

The upper nozzles 66*a* and 67*a* of the first and second nozzles 66 and 67, and the upper port receiving pipes 63*a* and 64*a* of the first and second port receiving pipes 63 and 64 may be disposed higher than a horizontal line OH passing through the center O of the gasket 60. The lower nozzles 66*b* and 67*b* of the first and second nozzles 66 and 67, and the lower port receiving pipes 63*b* and 64*b* of the first and second port receiving pipes 63 and 64 may be disposed lower than the horizontal line OH passing through the center O of the gasket 60. In order to smoothly spray water toward laundry contained in the drum 40 and to uniformly spray water to any laundry item at any location in the drum 40, a distance between each of the lower nozzles 66*b* and 67*b* or the lower port receiving pipes 63*b* and 64*b* and the horizontal line OH passing through the center O of the gasket 60 may be smaller than a distance between each of the upper nozzles 66*a* and 67*a* or the upper port receiving pipes 63*a* and 64*a* and the horizontal line OH passing through the center O of the gasket 60.

Laundry received in the drum 40 is piled up at a lower side in the drum 40 due to the weight of gravity. In order to smoothly spray water into the laundry received in the drum 40, the lower nozzles 66*b* and 67*b* need to be disposed at a height spaced a considerable distance from the lowest point in the gasket 60. For example, an angle formed by each of the lower nozzles 66*b* and 67*b*, the center O of the gasket 60, and the lowest point in the gasket 60 may be 45° or greater. In addition, an angle formed by the lower port receiving pipes 63*b* and 64*b*, the center O of the gasket 60, and the lowest point in the gasket 60 may be 45° or greater.

In order to uniformly spray water to laundry received in the drum 40, the upper nozzles 66*a* and 67*a* need to be spaced a considerable distance from the lower nozzles 66*b* and 67*b*. For example, an angle formed by the upper nozzle 66*a* and 67*a*, the center O of the gasket 60, and the horizontal line OH passing through the center O of the gasket 60 may be 30° or greater. In addition, an angle formed by each of the upper port receiving pipes 63*a* and 64*a*, the center O of the gasket 60, and the horizontal line OH passing through the center O of the gasket 60 may be 30° or greater.

Referring to FIGS. 6 and 7, a plurality of protruding part 65 may be formed in the inner circumferential surface 62 of the gasket at portion respectively corresponding to the plurality of port receiving pipes 63 and 64 to protrude inward, and the plurality of nozzles 66 and 67 may be formed at the protruding parts 65.

The protruding part 65 may include a first protruding part 65*a*, a second protruding part 65*b*, a third protruding part 65*c*, and a fourth protruding part 65*d* protruding inwardly at portions that respectively correspond to the first upper and lower port receiving pipes 63*a* and 63*b* and the second upper and lower port receiving pipes 64*a* and 64*b*. The first upper and lower nozzles 66*a* and 66*b* and the second upper and lower nozzles 67*a* and 67*b* may be respectively formed at the first protruding part 65*a*, the second protruding part 65*b*, the third protruding part 65*c*, and the fourth protruding part 65*d*.

Referring to FIGS. 6 to 10, the distribution pipe 80 includes the transport conduit 81 and 82 for guiding water pumped by the pump 70, and the outlet ports 83 and 84 protruding from the transport conduit 81 and 82 toward the gasket 60 and coupled to the port receiving pipe 63 and 64. In addition, the distribution pipe 80 may include an inlet port 85 introducing water discharged from the pump 70, and the transport conduit 82 may guide the water introduced through the inlet port 85 to the outlet ports 83 and 84.

The transport conduit 81 and 82 of the distribution pipe 80 is disposed on the outer circumferential surface 61 of the gasket body. The distribution pipe 80 may be inserted into the gasket 60 as the plurality of outlet ports 83 and 84 are inserted into the plurality of port receiving pipes 63 and 64. The transport conduit 81 and 82 of the distribution pipe 80 may be disposed between the outer circumferential surface 61 of the gasket body and the balancer 90. Accordingly, the distribution pipe 80 may be installed without a need for an additional space.

The distribution pipe 80 may be formed of synthetic resin that is harder or stiffer than the gasket 60. The distribution pipe 80 maintains a predetermined shape in spite of vibration occurring during operation of the washing machine, and the distribution pipe 80 is relatively rigid compared to the gasket 60 that transforms in response to vibration of the tub 30.

In addition, the circulation pipe 86 may be flexible to transform in response to vibration of the tub 30. In this case, the distribution pipe 80 may be formed of synthetic resin harder or stiffer than the circulation pipe 86.

A distribution pipe 80 of a washing machine according to a first embodiment of the present invention may have an upper side 88 that is in an open ring shape. That is, the distribution pipe 80 may include an inlet port 85 introducing water pumped by the pump 70, one or more outlet ports 83 and 84 discharging the introduced water to be spayed into the drum 40 and a transport conduit 81 and 82 connecting the inlet port 85 and the outlet ports 83 and 84. One end of a left conduit 81 of the transport conduit 81 and 82 and one end of a right conduit 82 of the transport conduit 81 and 82 may be connected to each other at a point where the inlet port 85 is disposed, whereas the other end of the left conduit 81 and the other end of the right conduit 82 may be separated from each other.

The inlet port 85 may be formed at a lower side of the transport conduit 81 and 82 to protrude downward, and the outlet port 83 and 84 may be formed at each of the left and right parts of the distribution pipe 80 to protrude inwardly (or toward the gasket). The circulation pipe 86 may be disposed between the inlet port 85 and a circulation port 87 formed in the pump 70, so that wash water in the tub is introduced into the inlet port 85 through the circulation pipe 86.

A plurality of outlet ports 83 and 84 may include plurality of upper outlet ports 83*a* and 84*a* coupled to the upper port receiving pipe 63*a* and 64*a* of the gasket 60, and a plurality of lower outlet ports 83*b* and 84*b* coupled to the lower port receiving pipe 63*b* and 64*b* of the gasket 60. The plurality of upper outlet ports 83*a* and 84*a* and the plurality of lower outlet ports 83*b* and 84*b* may protrude from the transport conduit 81 and 82 toward the gasket body 61 and 62 in directions parallel to each other (which is in other words parallel directions). The plurality of upper outlet ports 83*a* and 84*a* and the plurality of lower outlet ports 83*b* and 84*b* may protrude in parallel with a horizontal line OH passing through the center O of the gasket 60.

The outlet ports 83 and 84 protrude from an inner side (a surface toward the outer circumferential surface 61 of the gasket 60) of the transport conduit 81 and 82, and the outlet ports 83 and 84 are inserted into the port receiving pipes 63 and 64. The outlet ports 83 and 84 may guide circulating water, flowing along the transport conduit 81 and 82, to the nozzles to be thereby sprayed into the drum 40.

The outlet ports 83 and 84 may be formed with a diameter a bit greater than an inner diameter of the port receiving pipes 63 and 64, so that the outlet ports 83 and 84 can be press-fitted into the port receiving pipes 63 and 64. When the circulating water flows from the outlet port 83 and 84 toward the nozzles 66 and 67, a reaction force in a direction against the gasket 60 may be applied to a section where the outlet ports 83 and 84 are disposed in the transport conduit 81 and 82. In order to prevent separation of the distribution pipe 80 from the gasket 60 by the reaction force, the port receiving pipes 63 and 64 may be formed to protrude outward from the outer circumferential surface 61 of the gasket 60, and the outlet ports 83 and 84 may be formed with a diameter a bit greater than the inner diameter of the port receiving pipes 63 and 64.

The outlet ports 83 and 84 include a first outlet port 83 protruding from the left conduit part 81 of the transport conduit 81 and 82 toward a vertical line OV passing through the center O of the gasket 60, and a second outlet port 84 protruding from the right conduit part 82 of the transport conduit 81 and 82 toward the vertical line OV passing through the center O of the gasket 60. The first outlet port 83 is inserted into the first port receiving pipe 63 to guide circulating water to the first nozzle 66, and the second outlet port 84 is inserted into the second port receiving pipe 64 to guide circulating water to the second nozzle 67.

The first outlet port 83 may include a first lower outlet port 83*b* inserted into the first lower port receiving pipe 63*b*, and a first upper outlet port 83*a* disposed higher than the first lower outlet port 83*b* and inserted into the first upper port receiving pipe 63*a*. The second outlet port 84 may include a second lower outlet port 84*b* inserted into the second lower port receiving pipe 64*b*, and a second upper outlet port 84*a* disposed higher than the second lower outlet port 84*b* and inserted into the second upper port receiving pipe 64*a*.

The inlet port 85 is connected to the transport conduit 81 and 82 at a point lower than any of the plurality of outlet ports 83 and 84. The inlet port 85 is connected to the transport conduit 81 and 82 at a point lower than the plurality of lower outlet ports 83*b* and 84*b*.

The transport conduit 81 and 82 includes a first conduit part 81 forming the left side of the transport conduit 81 and 82 with reference to the inlet port 85, and a second conduit part 82 forming the right side of the transport conduit 81 and 82 with reference to the inlet port 85. The first conduit part 81 and the second conduit part 82 are connected at a lower side, and the inlet port 85 may protrude downward at the point where the first and second conduit parts are connected to each other.

The transport conduit 81 and 82 may be formed in an arc shape having a central angle of 180° or greater and an open upper side, and may be bilaterally symmetrical. The transport conduit 81 and 82 may include the first conduit part 81 disposed in the left side, and the second conduit disposed in the right side. The first conduit part 81 and the second conduit part 82 may be bilaterally symmetrical about the vertical line OV passing through the center O of the gasket 60.

The transport conduit 81 and 82 may branch water, introduced through the inlet port 85, to the left and right sides to guide upwardly. By branching the circulating water introduced through the inlet port, the transport conduit 81 and 82 may form a first sub-flow (water flowing along the first conduit part 81) and a second sub-flow (water flowing along the second conduit part 82). The first sub-flow may be sprayed into the drum 40 through the first nozzle 66, and the second sub-flow may be sprayed into the drum 40 through the second nozzle 67.

The transport conduit 81 and 82 may be disposed between the gasket 60 and the balancer 90. The transport conduit 81 and 82 may be disposed in a manner in which the inner surface of the transport conduit 81 and 82 opposes the gasket 60 and the outer surface of the transport conduit 81 and 82 opposes the balancer 90.

The port receiving pipes 63 and 64, the protruding parts 65, the nozzles 66 and 67, and the outlet ports 83 and 84 may vary in number and arrangement. In addition, it may be configured to omit the protruding parts 65 and the nozzles 66 and 67 and spray water from the outlet ports 83 and 84 into the drum 40. In addition, the nozzles 66 and 67 may be formed separately from the gasket 60 such that the nozzles 66 and 67 are coupled to the gasket 60 or spaced apart from the gasket 60.

Referring to FIGS. 3 and 5, one end of the circulation pipe 86 is connected to the inlet port 85 protruding from the bottom of the distribution pipe 80, and the other end of the circulation pipe 86 may be connected to the circulation port 78 of the pump 70. In the case where the circulation port 78 of the pump 70 is formed at a position facing the inlet port along a straight line, the circulation pipe 86 may have a straight pipe shape. However, in other cases, the circulation pipe 86 may be formed as a hose made from a flexible substance or may be formed by bending.

The circulation pipe 86 may be formed of a substance that is flexible but able to maintain a shape thereof. In the embodiment of the present invention, the circulation pipe 86*b* may be formed of ethylene propylene diene monomer rubber (EPDM). The circulation pipe 86 may include a bellows structure.

Referring to FIGS. 3 and 4, the washing machine according to an embodiment of the present invention includes the balancer 90 disposed at the front surface 31 of the tub 30. The balancer 90 may be fastened to the front surface 31 of the tub 30. The balancer 90 is used to reduce vibration of the tub 30, and the balancer 90 is a weight body having a predetermined weight. The balancer 90 may include one or more balancers 90 disposed along a circumference of the front surface 31 of the tub 30.

A balancer 90 of a washing machine according to the first embodiment of the present invention may include a first balancer 91 and a second balancer 92 respectively disposed to the left and right sides of the front surface 31 of the tub 30. The first balancer 91 may be disposed to the left side of the gasket 60, and the second balancer 92 may be disposed to the right side of the gasket 60.

In the case where the gasket body 61 and 62 is bilaterally divided into a first area and a second area, the first balancer 91 may be disposed at an outer side of the first area, and the second balancer 92 may be disposed at an outer side of the second area.

The first balancer 91 and the second balancer 92 may be spaced apart from each other both at an upper side and at a lower side. The first and second balancers 91 and 91 may be in a bilaterally symmetrical shape about the vertical line OV passing through the center O of the gasket 60, and may be disposed at positions bilaterally symmetrical about the vertical line.

Referring to FIGS. 10 to 13, the gasket 60 includes an accommodating part 610 in which at least a portion of the transport conduit 81 and 82 is disposed. The gasket body 61 and 62 is divided into a front body 60*a* disposed on the side of the casing 10, and a rear body 60*b* disposed on the side of the tub 30. A boundary between the front body 60*a* and the rear body 60*b* of the gasket body 61 and 62 may be placed on a plane vertical to a central axis of the gasket body 61 and 62.

The transport conduit 81 and 82 is disposed in the rear body 60*b*. The accommodating part 610 may be formed in the rear body 60*b*. The rear body 60*b* includes the accommodating part 610.

The accommodating part 610 may include a boundary surface 612 extending inward from a rear end of the front body 60*a*. The boundary surface 612 is bent from the rear end of the front body 60*a* to extend inward. The boundary surface 612 is disposed on the boundary B that divides the gasket body 61 and 62 into the front body 60*a* and the rear body 60*b*. For convenience of explanation, the boundary surface 612 is described as being included in the rear body 60*b*.

The accommodating part 610 includes an seating surface 611 extending rearward from the boundary surface 612. The seating surface 611 is bent at an inner end of the boundary surface 612 to extend rearward, and opposes the inner surface of the transport conduit 81 and 82.

The seating surface 611 extends from the rear body 60*b* in a circumferential direction of the gasket body 61 and 62. The boundary surface 612 extends from the seating surface 611 toward an outer side of a radial direction. The boundary surface 612 is connected to the front body 60*a*.

The boundary B dividing the gasket body 61 and 62 into the front body 60*a* and the rear body 60*b* may be disposed on the outer circumferential part 61*c*. That is, the rear body 60*b* with the transport conduit 81 and 82 disposed therein may be disposed on the outer circumferential part 61*c*. Accordingly, the accommodating part 610 may be disposed in the outer circumferential part 61*c*.

As described above, while the drum 40 is rotated, the tub 30 may vibrate, and the gasket 60 formed of a flexible substance may be folded or unfolded due to the vibration of the tub 30 and accordingly vibrate. Since the casing 10 and the tub 30 may be relatively rigid compared to the gasket 60, the gasket 60 is not deformed on the side of the casing 10 or on the side of the tub 30. Since the accommodating part 610 is formed to allow the transport conduit 81 and 82 to be seated therein, the accommodating part 610 may be formed on the outer circumferential surface 61 of the gasket 60 to be adjacent to the casing 10 or the tub 30. Further, since the transport conduit 81 and 82 is configured to spray water pumped by the pump to the nozzles 66 and 67 that sprays water into the drum, the transport conduit 81 and 82 may be disposed to be adjacent to the tub 30 in the embodiment of the present invention. Accordingly, the accommodating part 610 may be formed in the outer circumferential part 61*c*.

Meanwhile, due to vibration of the tub 30, interference between the accommodating part 610 and the inner circumferential part 61*b* may occur. The boundary surface 612 may be disposed at a rear side further than a bent portion between the inner circumferential part 61*b* and the rim part 61*a*. Accordingly, if the tub 30 vibrates in a radial direction, it is possible to prevent the intervention between the accommodating part 610 and the inner circumferential part 61*b*.

In addition, the seating surface 611 may be disposed at an outer side further than the bent portion between the inner circumferential part 61*b* and the rim part 61*a*. Accordingly, it is possible to prevent the intervention between the accommodating part 610 and the inner circumferential part 61*b* even when the tub 30 vibrates in a front-back direction.

When a portion bent outward from the rim part 61*a* is defined to be included in the inner circumferential part 61, the bent portion between the inner circumferential part 61*b* and the rim part 61*a* refer to a portion bent from the rim part 61 of the inner circumferential part 61*b*.

The accommodating part 610 may be formed at the most rear side (in a direction toward the tub 30) of the outer circumferential part 61*c*. In this case, the boundary surface 612 may be formed at a front side (in a direction toward the casing 10) of the accommodating part 610, and the accommodating part 610 may not have a rear surface.

The accommodating part 610 is formed to be recessed inward further than a portion adjacent toward a front side of the accommodating part 610. The accommodating part 610 may be formed in a manner in which at least a portion of the outer circumferential surface 61 of the gasket 60 is recessed inward or in a manner in which a portion of the outer circumferential surface 61 of the gasket 60 protrudes (or is raised) and the accommodating part 610 is formed on one side of the protruding portion.

Meanwhile, a width of the transport conduit 81 and 82 in the front-back direction of the washing machine may be greater than a width of the transport conduit 81 and 82 in a radial direction of the transport conduit 81 and 82. The width in the front-back direction refers to a width of the inner surface of the transport conduit 81 and 82, and the width in the radial direction refers to a distance between the inner surface and the outer surface of the transport conduit 81 and 82. That is, a cross section of the transport conduit 81 and 82 may be formed in a shape in which a width of a surface of the accommodating part 610 opposing the seating surface 611 is greater than a width of a surface of the accommodating part 610 opposing the boundary surface 612.

For example, the cross section of the transport conduit 81 and 82 may be in a rectangular shape. In this case, a long edge of the rectangular shape corresponds to the width in the front-back direction, and a short edge of the rectangular shape corresponds to the width in the radial direction. Due to this structure, it is possible to install the distribution pipe 80 even in a narrow space between the gasket 60 and the balancer 90.

In addition, an inner surface of at least a portion of the transport conduit 81 and 82 is disposed between the front body 60*a* and the seating surface 611 in the radial direction. That is, the inner surface of at least a portion of the transport conduit 81 and 82 may be disposed between the seating surface 611 and a virtual plane extending rearward from a rear end of the front body 60*a*. Since the gasket body 61 and 61 has an approximately cylindrical shape, a width of the gasket body 61 and 62 in a left-right direction has the maximum value at a height equal to a height of the center O of the gasket body 61 and 62. In other words, the width of the gasket body 61 and 62 in the left-right direction has the maximum value on a horizontal plane passing through the center O of the gasket body 61 and 62. Accordingly, at a height equal to the height of the center O of the gasket body 61 and 62, the inner surface of the transport conduit 81 and 82 is disposed in a radial direction between the front body 60*a* and the seating surface 611.

In order to allow the transport conduit 81 and 82 to be placed in the accommodating part 610, a width of the seating surface 611 may be formed to be equal to or greater than a width of the transport conduit 81 and 82.

Meanwhile, in order to allow a portion of the transport conduit 81 and 82 to be placed in the accommodating part 610, the accommodating part 610 may extend from above the center O of the gasket 60 (which can be called a horizontal line OH passing through the center O of the gasket) to below the lowest outlet ports 83*b* and 84*b* (or the lowest port receiving pipes 63*b* and 64*b*) along a circumferential direction of the gasket 60. In addition, the accommodating part 610 may be bilaterally symmetrical about the center O of the gasket 60. Accordingly, the lower port receiving pipes 63*b* and 64*b* may protrude from the seating surface of the accommodating part 610.

As described above, a distance between each of the lower port receiving pipe 63*b* and 64*b* and the horizontal line OH is shorter than a distance between each of the port receiving pipes 63*a* and 64*a* and the horizontal line OH. Thus, a distance between the first and second lower port receiving pipes 63*b* and 64*b* may be greater than a distance between the first and second upper port receiving pipes 63*a* and 64*a*. Accordingly, it is possible to position the distribution pipe 80 in a narrow space between the gasket and the balancer 90 as the lower port receiving pipes 63*b* and 64*b* are disposed in the accommodating part 610.

The accommodating part 610 may extend from below the lower port receiving pipes 63*b* and 64*b* to above the upper port receiving pipes 63*a* and 64*a* along the circumferential direction of the gasket 60. In this case, not just the lower port receiving pipes 63*b* and 64*b*, but also the upper port receiving pipes 63*a* and 64*a* may protrude from the accommodating part 610.

Alternatively, in order to allow the whole transport conduit 81 and 82 to be seated in the accommodating part 610, the accommodating part 610 may be formed from above the highest portion of the transport conduit 81 through the lowest side of the gasket 60 to above the highest portion of the opposite transport conduit 82 along a circumferential surface in a state in which the distribution pipe 80 is coupled to the gasket 60.

Since the accommodating part 610 vertically extends with reference to the center O of the gasket 60 at which the gasket 60 has a maximum width in the left-right direction, it is possible to install the distribution pipe 80 even in a narrow space between the gasket 60 and the balancer 90 if only a portion of the transport conduit 81 and 82 is be seated in the accommodating part 610.

Figure 10:
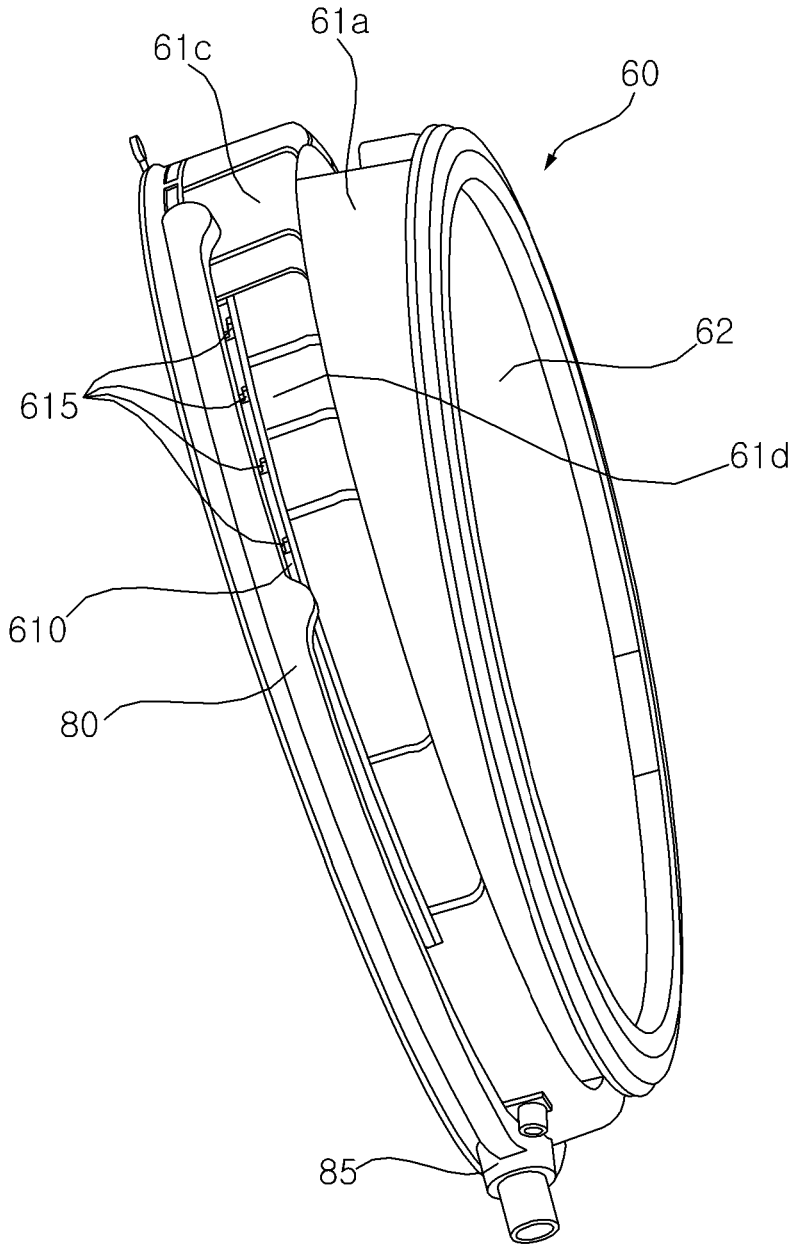
FIG. 10 is a perspective view of the assembly shown in FIG. 6.
Figure 11:
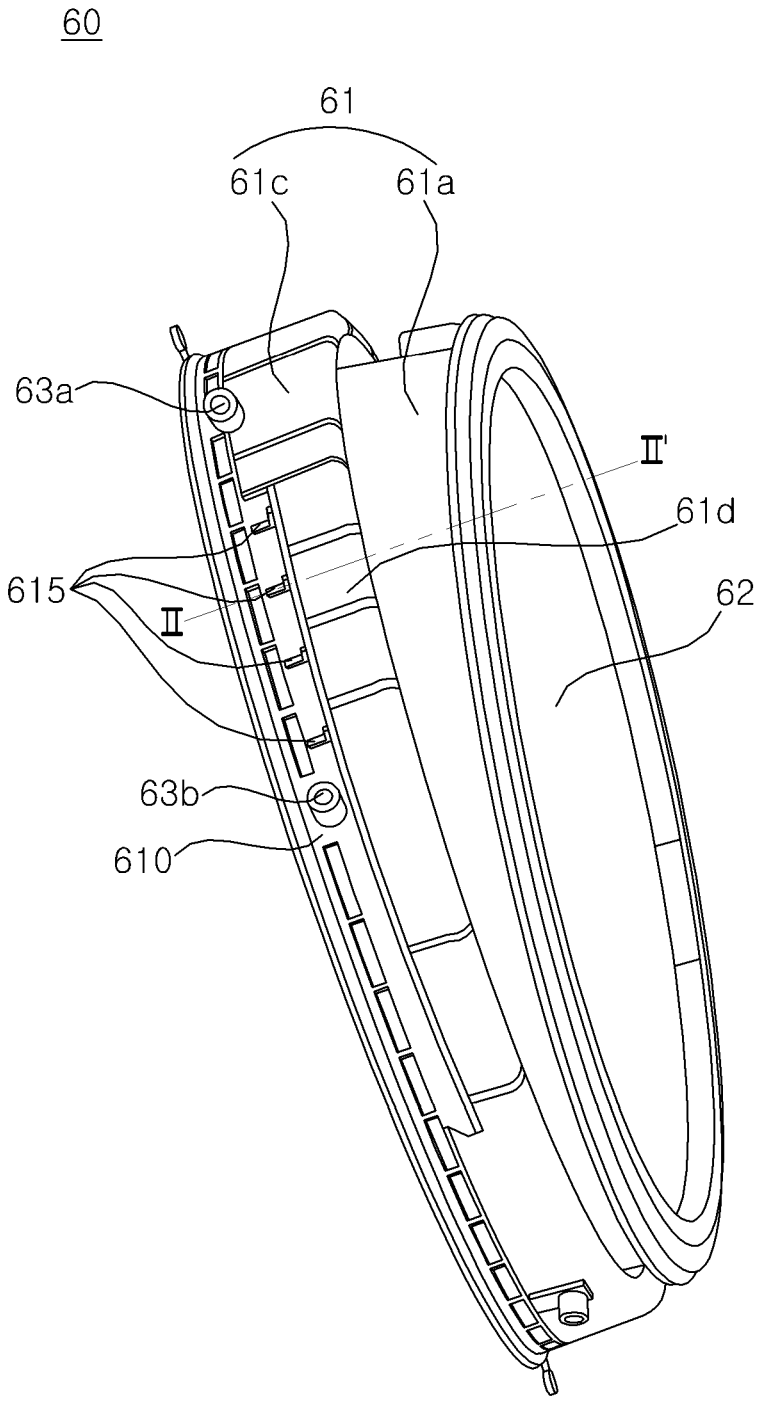
FIG. 11 is a perspective view of the gasket shown in FIG. 6.
Figure 12:
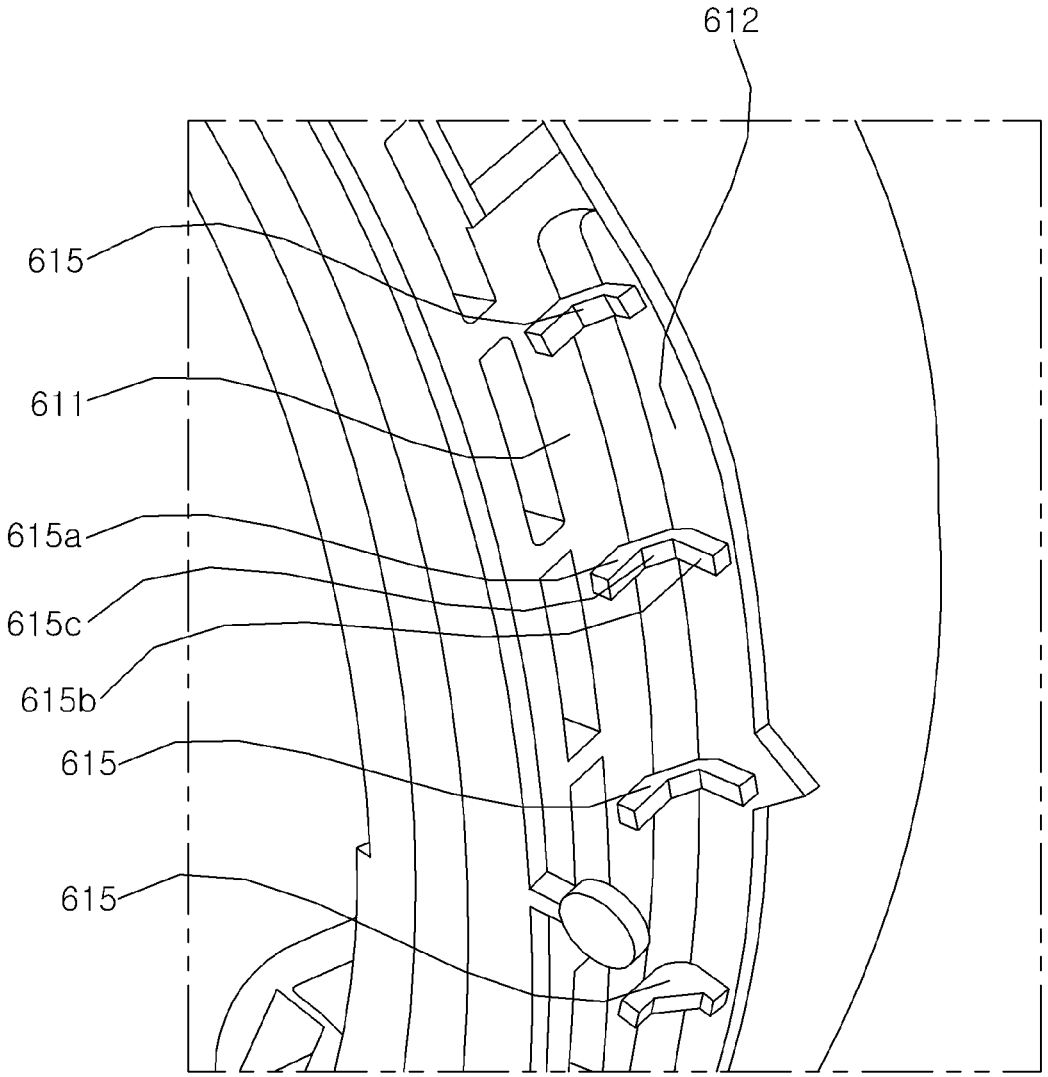
FIG. 12 is an enlarged view illustrating an accommodating part of the gasket shown in FIG. 11.
Figure 13:
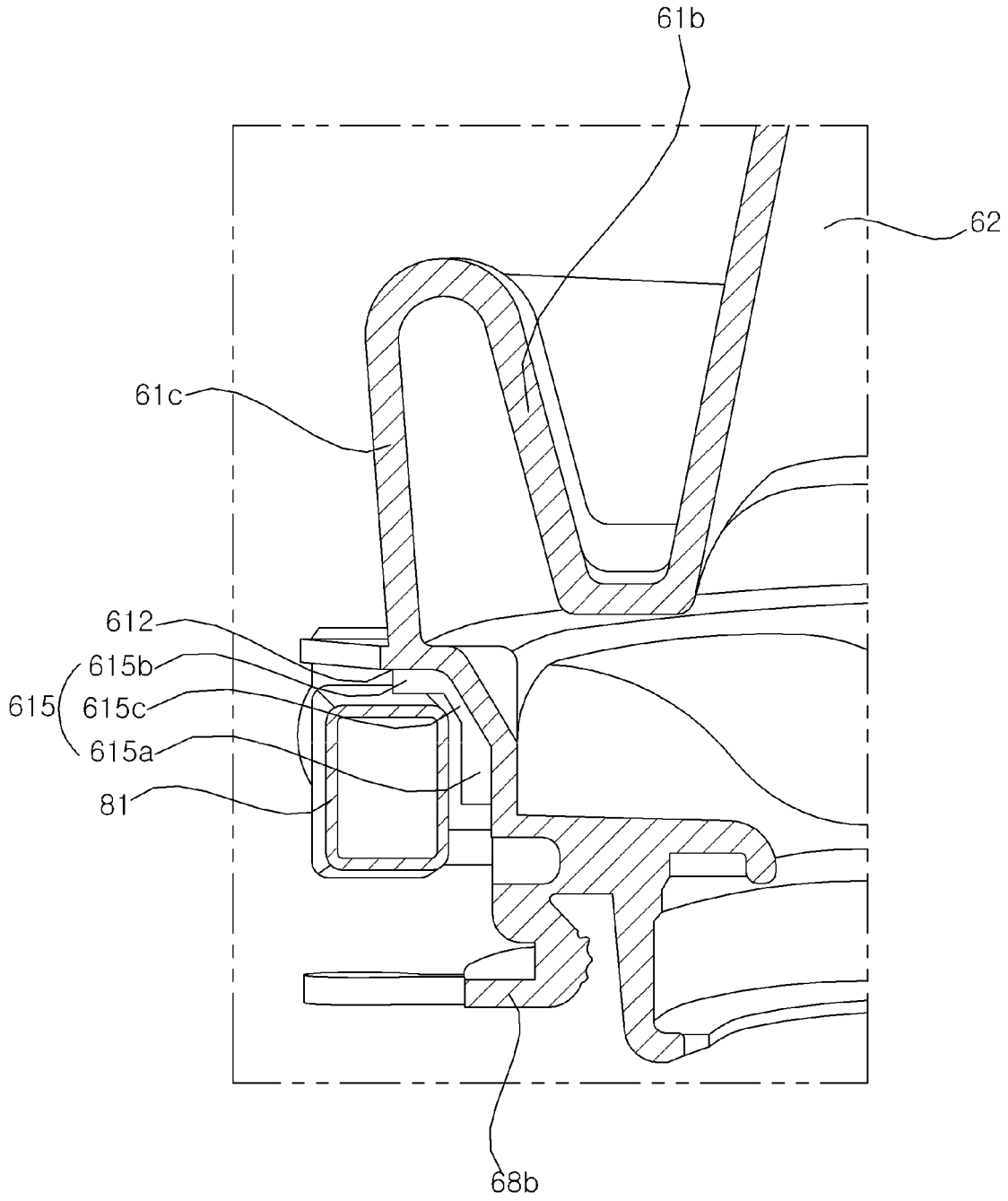
FIG. 13 is a cross-sectional view of a gasket cut away along line II-II in FIG. 12.

Referring to FIGS. 10, 11, and 12, a rib 615 may be formed in the outer circumferential surface 61 of the gasket body. The rib 615 may protrude from the outer circumferential surface 61 of the gasket 60 in the radial direction of the gasket 60. That is, the rib 615 may be formed to extend in a direction orthogonal to a tangent line of the outer circumferential surface 61 of the gasket body.

The distribution pipe 80 may be disposed to have at least a portion thereof brought into contact with the rib 615. At least a portion of the transport conduit 81 and 82 in the distribution pipe 80 may be brought into contact with the rib 615.

The rib 615 may include one or more ribs 615, and a plurality of ribs may be spaced apart from each other in the circumferential direction of the gasket body 61 and 62. Although four ribs are formed on one of the left and right sides of the gasket in FIG. 12, the rib 615 may vary in number and arrangement.

Friction between the distribution pipe 80 and the gasket 60 occurs due to vibration of the tub 30 and the weight of gravity. This friction may be relatively more intense occur frequently in an area around the center of the up-down direction of the gasket 60. In addition, when water is sprayed through nozzles upon operation of the pump 70, a reaction force may be applied to the distribution pipe 80 and the friction may occur more intensely and frequently in an area around the outlet ports 83 and 84. Accordingly, the rib 615 may be provided between the upper port receiving pipe 63*a* and 64*a* and the lower port receiving pipe 63*b* and 64*b*.

Since at least a portion of the distribution pipe 80 is positioned in the accommodating part 610, the rib 615 may be formed in the accommodating part 610. The rib 615 may protrude from the accommodating part 610 toward the transport conduit 81 and 82. The rib 615 may include either or both of a first protrusion 615*a* formed in the seating surface 611 of the accommodating part 610 and a second protrusion 615*b* formed in the boundary surface 612. Hereinafter, an example in which the rib 615 includes both the first protrusion 615*a* and the second protrusion 615*b* will be described.

The first protrusion 615*a* may protrude from the seating surface 611 of the accommodating part 610 toward an outer side of a radial direction of the gasket body, and the second protrusion 615*b* may protrude from the boundary surface 612 toward the tub 30. The first protrusion 615*a* may come into contact with an inner surface of the transport conduit 81 and 82 opposing the seating surface 611, and the second protrusion 615*b* may come into contact with the front surface of the transport conduit 81 and 82 opposing the boundary surface 612 of the accommodating part 610.

Vibration of the tub 30 may cause the inner circumferential part 61*b* of the gasket 60 to be folded or unfolded, or the vibration may be delivered. In order to prevent friction between the distribution pipe 80 and the outer circumferential surface 61 of the gasket 60 to delay abrasion, the rib 615 may be formed. Accordingly, the rib 615 may be formed in the seating surface 611 and the boundary surface 612 of the accommodating part 610 in which friction occurs due to vibration of the tub 30 and the gasket 60.

On the contrary, since the gasket 60 is coupled to the tub 30, vibration of relative small amplitude may occurs at a position adjacent to the tub 30, the outer circumferential surface 61 of the gasket 60 (or the accommodating part 610) may not have a portion that comes into contact with the distribution pipe 80 toward the tub 30, and the front surface 31 of the tub 30 and the distribution pipe 80 may be spaced apart from each other, and therefore, even if a rib is not installed between the tub 30 and the distribution pipe 80, abrasion of the gasket 60 or the like may not occur.

The first protrusion 615*a* and the second protrusion 615*b* may be formed at different latitudes to be spaced apart each other. Alternatively, the first protrusion 615*a* and the second protrusion 615*b* may be formed at the same latitude to be spaced apart from each other or continue.

Here, the term "latitude" refers to an angle relative to a horizontal line OH passing through the center O of the gasket 60 (which is a straight line orthogonal to the vertical line OV, when seen from the front). A latitude on the left side of the gasket is measured in the clock-wise direction, and a latitude on the right side of the gasket is measured in the counter clockwise-direction. Accordingly, the term "latitude" may be integrated to be similar as used in a map.

The rib 615 may include a connecting protrusion 615*c* formed between the first protrusion 615*a* and the second protrusion 615*b* and connecting the first protrusion 615*a* and the second protrusion 615*b*. The connecting protrusion 615*c* may be formed between the first protrusion 615*a* and the second protrusion 615*b* so that an edge having an angle of 90° between the first protrusion 615*a* and the second protrusion 615*b* may not be formed. In the case where the connecting protrusion 615*c* is formed between the first protrusion 615*a* and the second protrusion 615*b*, the transport conduit 81 and 82 may be brought into contact with the connecting protrusion 615. In this case, abrasion of the first protrusion 615*a* and the second protrusion 615*b* may be delayed.

When the gasket 60 is molded, the rib 615 may be formed integrally with the gasket 60 using the same substance of the gasket 60.

Meanwhile, referring to FIGS. 7, 10, 11, and 12, an accommodating part 610 of a washing machine according to a first embodiment of the present invention may be formed at one side (a rear side) of a raised portion 61*d* that corresponds to a outwardly protruding portion of the outer circumferential surface 61 of the gasket 60. As the raised portion 61 may be formed at a front side from the outer circumferential surface 61*c*, the accommodating part 610 may be formed at a rear side of the outer circumferential part 61*c*. The raised portion 61*d* may be disposed in the front body 60*a*.

As described above, in order to form the accommodating part 610 from above the center O of the gasket to below the lowest port receiving pipes 63*b* and 64*d*, the raised portion 71*d* may be formed on both the left and right sides from the upper side of the center O of the gasket 60 to the lowest port receiving pipes 63*b* and 64*b*.

When the gasket body 61 and 62 is bilaterally divided into a first area and a second area, the accommodating part 610 may include a first accommodating part 610*a* disposed in the first area and a second accommodating part 610*b* disposed in the second area. That is, the accommodating part 610 may include the first accommodating part 610*a* formed in the left-side outer circumferential surface 61 of the gasket body, and a second accommodating part 610*b* formed in the right-side outer circumferential surface 61 of the gasket body 61 and 62. In this case, the lowest port receiving pipes 63*b* and 64*b* may protrude from the seating surface 611 of the accommodating part 610. More specifically, the first lower port receiving pipe 63*b* may protrude from the seating surface 611 of the first accommodating part 610*a*, and the second lower port receiving pipe 64*b* may protrude from the seating surface 611 of the second accommodating part 610*b*.

The left part of the transport conduit 81 and 82, that is, the first transport conduit 81, may have at least a portion disposed between the outer circumferential surface 61 of the gasket 60 and the first balancer 91 and disposed in the first accommodating part 610*a*. The right part of the transport conduit 81 and 82, that is, the second transport conduit 82, may have at least a portion disposed between the outer circumferential surface 61 of the gasket 60 and the second balancer 92 and disposed in the second accommodating part 610*b*.

At least a portion of the first conduit part 81 may be disposed between the seating surface 611 of the first accommodating part 610*a* and the first balancer 91. At least a portion of the second conduit part 82 may be disposed between the seating surface 611 of the second accommodating part 610*b* and the second balancer 92.

In addition, one or more ribs 615 may be formed in each of the first accommodating part 610*a* and the second accommodating part 610*b*. In addition, at least a portion of the left part 81 of the transport conduit 81 and 82 may be brought into contact with a rib 615 formed in the first accommodating part 610, and at least a portion of the right part 82 of the transport conduit 81 and 82 may be brought into contact with a rib 615 formed in the second accommodating part 610*b*. The rib 615 may be formed in the first accommodating part and provided in plural between the first upper port receiving pipe 63*a* and the first lower part receiving pipe 63*b* along the circumferential direction of the gasket 60. The rib 615 may be formed in the second accommodating part and provided in plural between the second upper port receiving pipe 64*a* and the second lower part receiving pipe 64*b* along the circumferential direction of the gasket 60.

Meanwhile, the accommodating part 610 is formed by the raiser portion 61*d*, the aforementioned boundary surface 612 of the accommodating part 610 is a surface that connects the seating surface 611 of the accommodating part 610 and the riser portion 61*d*.

As described above, at least a portion of the transport conduit 81 and 82 may be disposed in the accommodating part. The inner surface of the transport conduit 81 and 82, that is, a surface toward the gasket 60, may have a portion that is seated in the seating surface 611 or is brought into contact with the first protrusion 615*a*. A portion on the front surface of the transport conduit 81 and 82 may be seated in the boundary surface 612 of the accommodating part or is brought into contact with the second protrusion 615*b*. Since the tub 30 is disposed at the rear of the transport conduit 81 and 82, a portion of the transport conduit 81 and 82 is allowed to be seated in a space between the seating surface 611 and the boundary surface 612 of the accommodating part.

Figure 14:
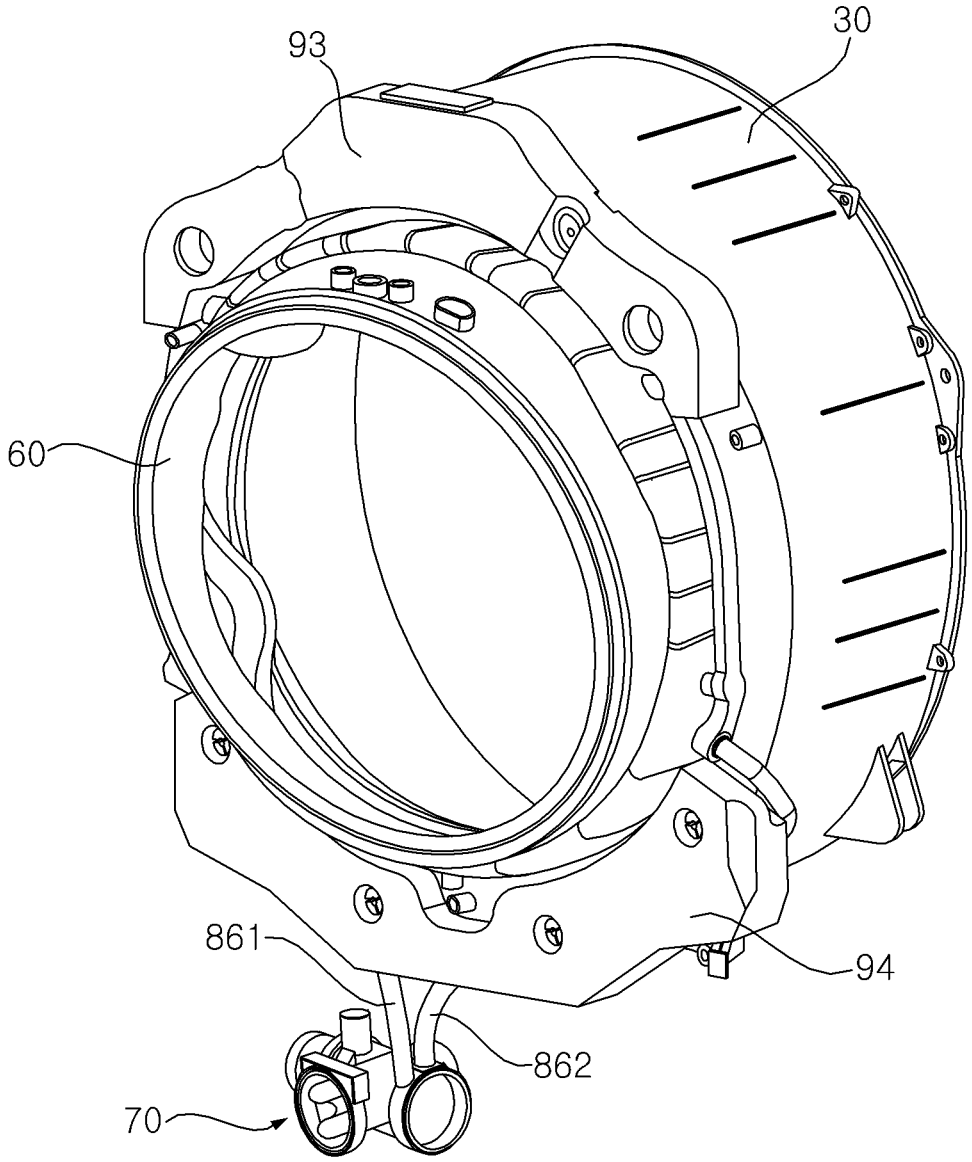
FIG. 14 is a view illustrating a portion of a washing machine according to a second embodiment of the present invention.
Figure 15:
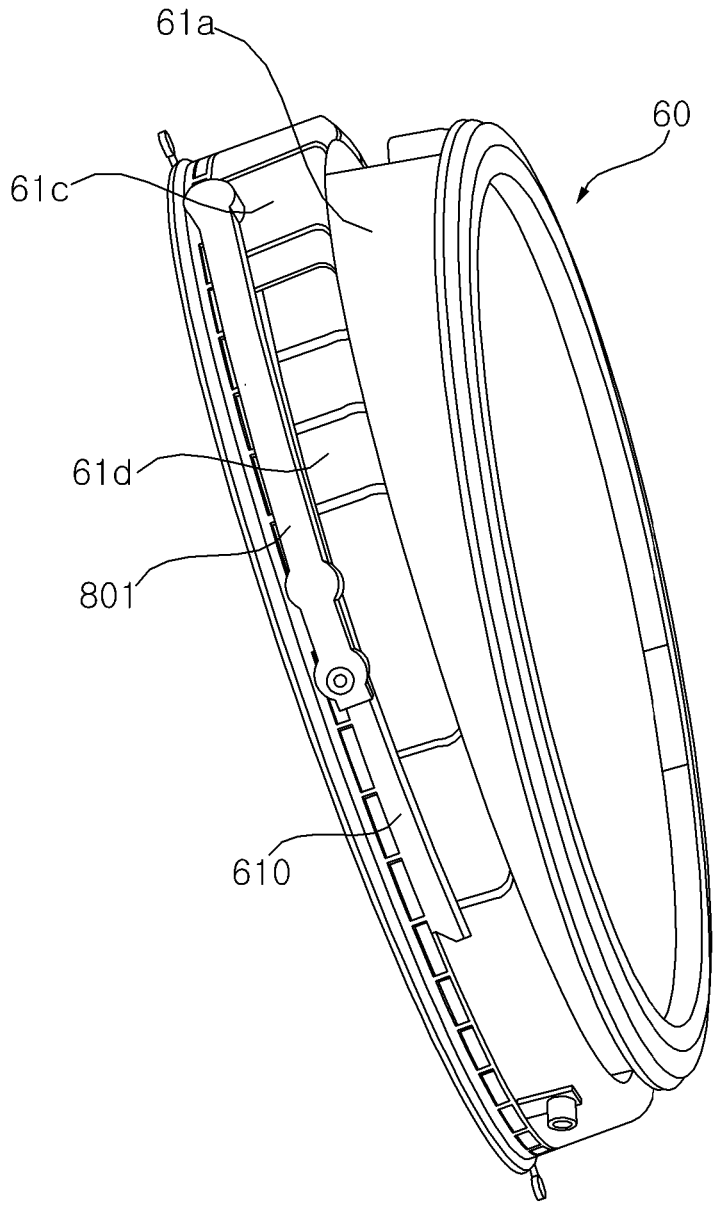
FIG. 15 is a view illustrating a distribution pipe and a gasket shown in FIG. 14.
Figure 16:
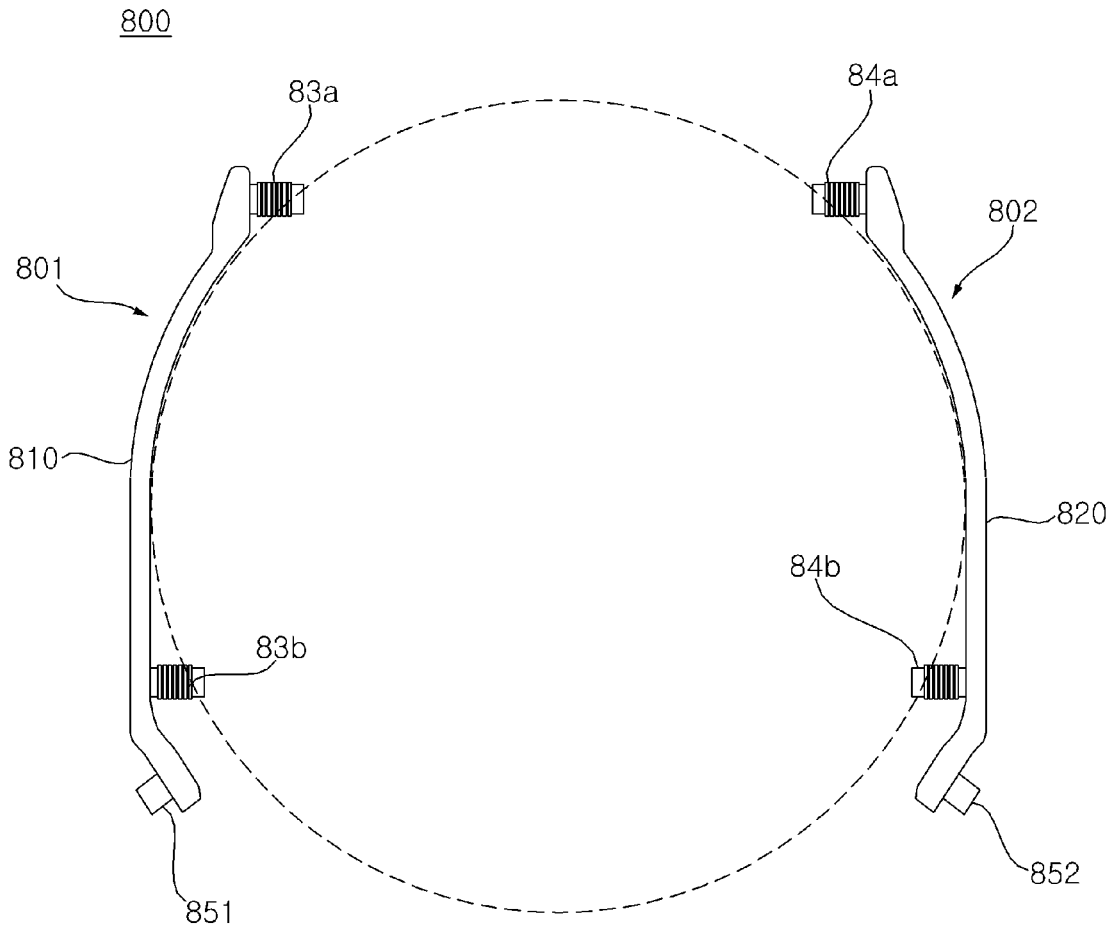
FIG. 16 is a front view of the distribution pipe shown in FIG. 14.

Referring to FIGS. 14, 15, and 16, a washing machine according to a second embodiment of the present invention is different from the washing machine according to the first embodiment in terms of structures of the balancer 90 and the distribution pipe 800.

The washing machine according to the second embodiment of the present invention may include a balancer 90, which is disposed at a front surface 31 of the tub 30 and separated vertically, and a distribution pipe 800, which includes a first distribution pipe 801 and a second distribution pipe 802 respectively provided on the left and right sides of the outer circumferential surface 61 of the gasket body. Other configurations and operations are identical or similar to the first embodiment, and thus, like components are given like reference numerals and a detailed description thereof is herein omitted.

The balancer according to the second embodiment may include an upper balancer 93 at an upper side of a gasket 60, and a lower balancer 94 at a lower side of the gasket 60.

The first and second distribution pipes 801 and 802 are connected to a pump 70 through separate circulation pipes 861 and 862, respectively. The first and second distribution pipes 801 and 802 may supply water, pumped by the pump 70, to a first nozzle and a second nozzle.

A first inlet port 851 and a second inlet port 852 may be formed at lower sides of the first distribution pipe 801 and the second distribution pipe 802, respectively. Each of the first and second distribution pipes 801 and 802 may respectively include upper and lower outlet ports 830 and 840. The first and second distribution pipes 801 and 802 respectively include a first transport conduit 810 and a second transport conduit 820 to guide circulating water, supplied through the inlet ports 851 and 852, to the outlet ports 830 and 840.

The first transport conduit 810 is disposed on an outer circumferential surface of a first area, and the second transport conduit 820 is disposed on an outer circumferential surface of a second area. At least a portion of the first conduit 810 and at least a portion of the second transport conduit 820 may be respectively disposed in a first accommodating part 610*a* and a second accommodating part 610*b*.

The first distribution pipe 801 may include a first upper outlet port 83*a* disposed higher than the center O of the gasket 60, and a first lower outlet port 83*b* disposed lower than the center O of the gasket 60 and higher than the first inlet port 851. The second distribution pipe 802 may include a second upper outlet port 84*a* disposed higher than the center O of the gasket 60, and a second lower outlet port 84*b* disposed lower than the center O of the gasket 60 and higher than the second inlet port 852. Likewise in the first embodiment, the outlet ports 83*a*, 83*b*, 84*a*, and 84*b* may be connected to the first upper and lower port receiving pipes 63*a* and 63*b* and the second upper and lower port receiving pipes 64*a* and 64*b* to spray or discharge circulating water into a drum 40.

Figure 17:
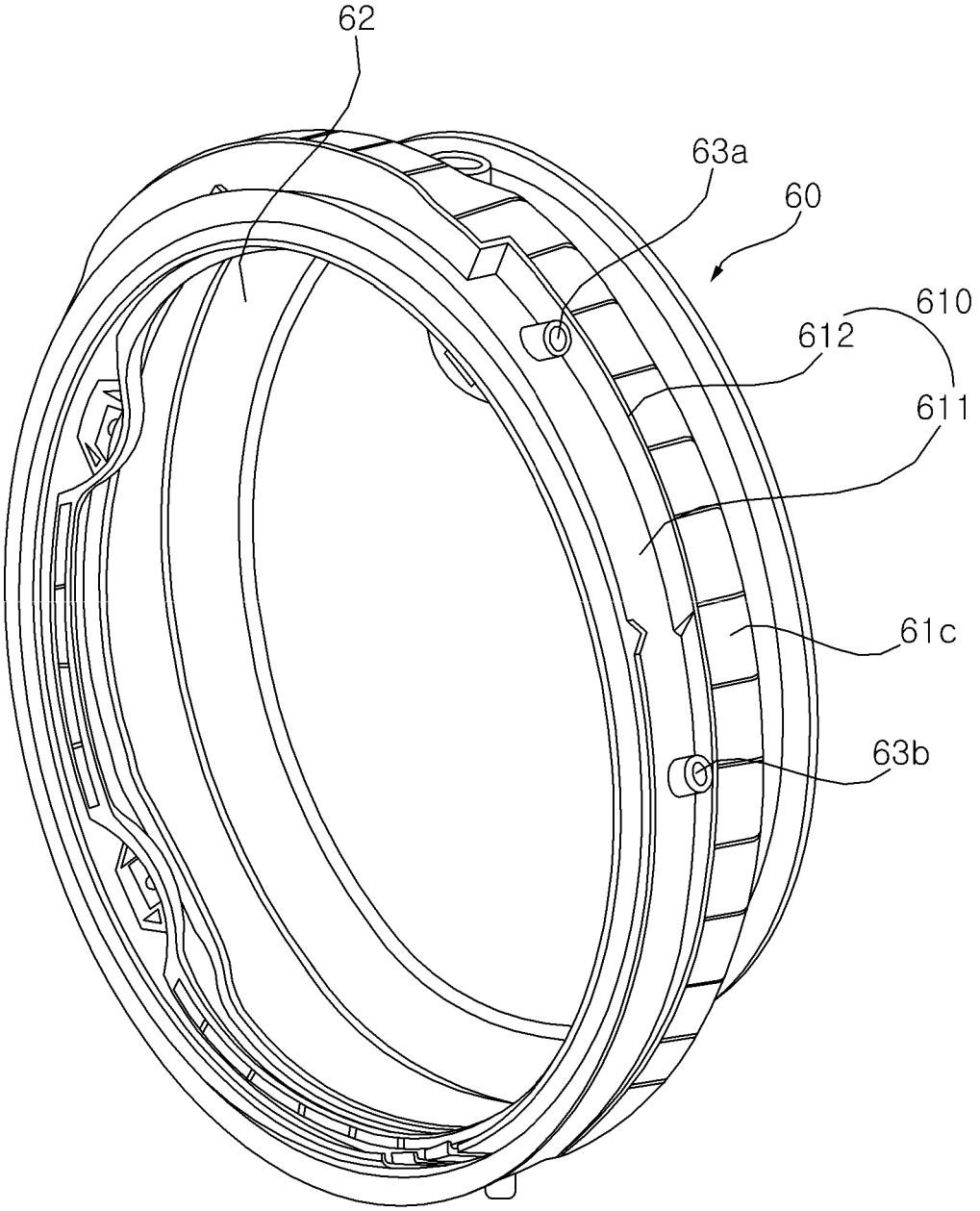
FIG. 17 is a view illustrating an accommodating part of a gasket of a washing machine according to a third embodiment of the present invention.
Figure 18:
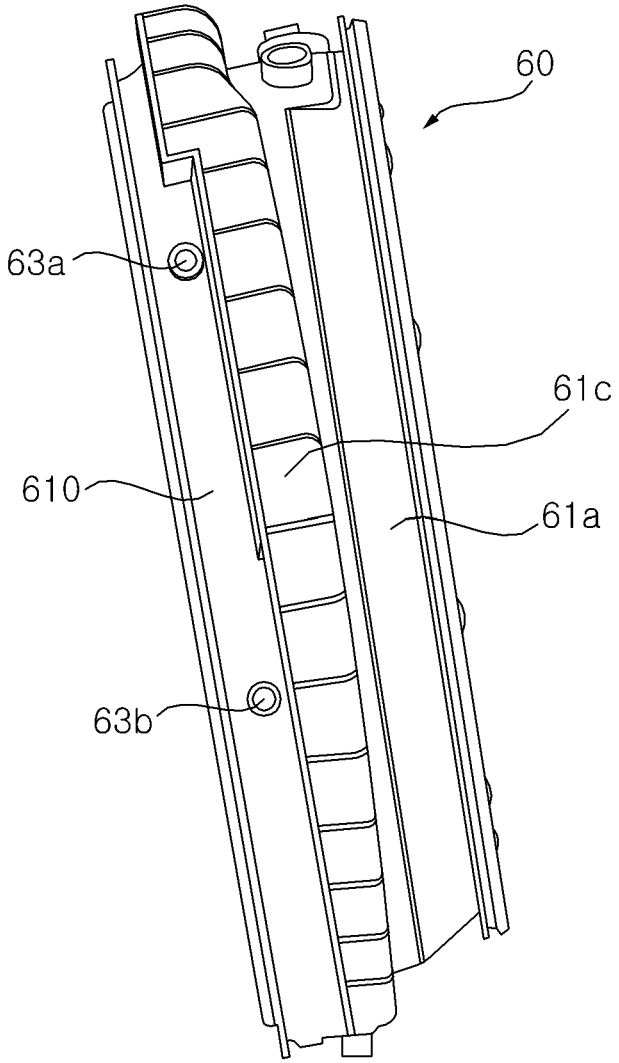
FIG. 18 is a right-side view of the gasket shown in FIG. 17.

Referring to FIGS. 17 and 18, a washing machine according to a third embodiment of the present invention is different from the first embodiment in terms of the shape of a gasket 60. Other configurations and operations are identical or similar to the first embodiment, and thus, like components are given like reference numerals and a detailed description thereof is herein omitted.

The washing machine according to the third embodiment may include an accommodating part 610 formed inward on an outer circumferential surface 61 of the gasket 60 to allow at least a portion of a transport conduit 81 and 82 to be positioned therein. The accommodating part 610 may be formed in a manner in which at least a portion of the outer circumferential surface is recessed inward.

Meanwhile, in order to allow the whole transport conduit 81 and 82 to be seated, the accommodating part 610 may be formed from above the highest portion of the first conduit part 81 through the lowest side of the gasket 60 to above the highest portion of the second conduit part 82 along a circumferential surface in a state in which the distribution 80 is coupled to the gasket 60.

Alternatively, in order to allow a portion of the transport conduit 81 and 81 to be seated, the accommodating part 610 may be formed from above the highest portion of the transport conduit 81 and 82 to below the lowest outlet ports 83*b* and 84*b* (or the lowest port receiving pipes 63*b* and 64*b*), and the accommodating part 610 may be bilaterally symmetrical about the center O of the gasket 60.

Although not illustrated in the drawings regarding the third embodiment of the present invention, a rib 615 as the same as the rib 615 in the first embodiment may be formed.

Although some embodiments have been described above, it should be understood that the present invention is not limited to these embodiments, and that various modifications, changes, alterations and variations can be made by those skilled in the art without departing from the spirit and scope of the invention. Therefore, it should be understood that the above embodiments are provided for illustration only and are not to be construed in any way as limiting the present invention.

What is claimed is:

1. A washing machine comprising:

a casing that defines a laundry entry hole at a front surface of the casing;

a tub disposed in the casing, the tub defining a tub opening at a front surface of the tub;

a drum rotatably disposed in the tub and configured to receive laundry;

a gasket that defines a passage connecting the laundry entry hole to the tub opening;

a plurality of nozzles disposed at an inner circumference of the gasket and configured to spray water into the drum;

a pump configured to circulate water discharged from the tub; and a distribution pipe configured to supply, to the plurality of nozzles, water pumped by the pump, wherein the distribution pipe comprises:

a transport conduit that is disposed on an outer circumference of the gasket and extends along the outer circumference of the gasket, and a plurality of outlet ports that protrude from the transport conduit toward the gasket and that are configured to supply water to the plurality of nozzles, wherein the gasket comprises a front body connected to the casing and a rear body connected to the tub, wherein the rear body comprises an accommodating part configured to receive at least a portion of the transport conduit, and wherein the accommodating part comprises:

a boundary surface that is bent radially inward from a rear end of the front body toward the passage of the gasket, and a seating surface that is bent rearward from a radial inner end of the boundary surface toward the tub and faces the transport conduit in a radial direction of the gasket.

2. The washing machine of claim 1, wherein the gasket further comprises:

a rim part that extends from the casing toward the tub;

an inner circumferential part that is bent outward from the rim part and that extends toward the casing; and an outer circumferential part that is bent outward from the inner circumferential part and that extends toward the tub, wherein a diameter of the outer circumferential part is greater than a diameter of the inner circumferential part, and wherein the rear body is disposed at the outer circumferential part.

3. The washing machine of claim 2, wherein the boundary surface is disposed rearward of a portion of the inner circumferential part bent from the rim part.

4. The washing machine of claim 2, wherein the seating surface is disposed outward of a portion of the inner circumferential part bent from the rim part.

5. The washing machine of claim 1, wherein the transport conduit comprises an inner surface facing the outer circumference of the gasket, and wherein at least a portion of the inner surface of the transport conduit is disposed between the seating surface and a virtual plane that extends rearward from the rear end of the front body toward the tub.

6. The washing machine of claim 1, wherein the accommodating part comprises:

a first accommodating part disposed in a first area of the gasket; and a second accommodating part disposed in a second area of the gasket facing the first area of the gasket.

7. The washing machine of claim 6, wherein the gasket further comprises a plurality of port receiving pipes that protrude from the outer circumference of the gasket and that are configured to communicate with the plurality of nozzles, respectively, wherein the plurality of port receiving pipes comprise a first upper port receiving pipe and a first lower port receiving pipe that are vertically disposed in the first area of the gasket, wherein the plurality of outlet ports comprises:

a first upper outlet port coupled to the first upper port receiving pipe; and a first lower outlet port coupled to the first lower port receiving pipe.

8. The washing machine of claim 7, wherein the first lower port receiving pipe is disposed vertically below a horizontal line that passes through a center of the gasket, wherein the first upper port receiving pipe is disposed vertically above the horizontal line, and wherein a vertical distance between the first lower port receiving pipe and the horizontal line is less than a vertical distance between the first upper port receiving pipe and the horizontal line.

9. The washing machine of claim 8, wherein the first accommodating part extends along a circumferential direction of the gasket from a first portion above the horizontal line to a second portion below the first lower port receiving pipe, and wherein the first lower port receiving pipe protrudes from the seating surface of the first accommodating part.

10. The washing machine of claim 7, wherein the first lower port receiving pipe and the first upper port receiving pipe protrude extend parallel to each other, and wherein the first lower outlet port and the first upper outlet port extend parallel to each other.

11. The washing machine of claim 7, wherein the plurality of port receiving pipes further comprise a second upper port receiving pipe and a second lower port receiving pipe that are vertically disposed in the second area of the gasket, and wherein the plurality of outlet ports comprise:

a second upper outlet port coupled to the second upper port receiving pipe; and a second lower outlet port coupled to the second lower port receiving pipe.

12. The washing machine of claim 11, wherein the distribution pipe further comprises an inlet port that is configured to receive water pumped by the pump and that protrudes downward from the transport conduit at a point lower than the first lower outlet port and the second lower outlet port, and wherein the transport conduit comprises:

a first conduit part disposed on an outer circumference of the first area of the gasket and configured to guide, to the first lower outlet port and the first upper outlet port, water received through the inlet port; and a second conduit part disposed on an outer circumference of the second area of the gasket and configured to guide, to the second lower outlet port and the second upper outlet port, water received through the inlet port.

13. The washing machine of claim 12, further comprising a balancer disposed at the front surface of the tub, wherein the balancer comprises a first balancer disposed at an outer side of the first area of the gasket and a second balancer disposed at an outer side of the second area of the gasket, wherein at least a portion of the first conduit part is disposed between a seating surface of the first accommodating part and the first balancer, and wherein at least a portion of the second conduit part is disposed between a seating surface of the second accommodating part and the second balancer.

14. The washing machine of claim 11, wherein the plurality of nozzles comprise:

a first upper nozzle configured to communicate with the first upper port receiving pipe, a first lower nozzle configured to communicate with the first lower port receiving pipe, a second upper nozzle configured to communicate with the second upper port receiving pipe, and a second lower nozzle configured to communicate with the second lower port receiving pipe, wherein the distribution pipe comprises:

a first distribution pipe configured to supply, to the first upper nozzle and the first lower nozzle, water pumped by the pump, and a second distribution pipe configured to supply, to the second upper nozzle and the second lower nozzle, water pumped by the pump, wherein the first distribution pipe comprises:

a first transport conduit disposed on an outer circumference of the first area of the gasket, a first inlet port configured to receive water pumped by the pump and disposed vertically below the first lower outlet port, the first inlet port protruding from the first transport conduit, and the first upper outlet port and the first lower outlet port, and wherein the second distribution pipe comprises:

a second transport conduit disposed on an outer circumference of the second area of the gasket, a second inlet port configured to receive water pumped by the pump and disposed vertically below the second lower outlet port, the second inlet port protruding from the second transport conduit, and the second upper outlet port and the second lower outlet port.

15. The washing machine of claim 1, wherein a first width of the transport conduit in a front-rear direction of the washing machine is greater than a second width of the transport conduit in the radial direction of the gasket.

16. The washing machine of claim 1, wherein the gasket further comprises a rib that protrudes from the accommodating part toward the transport conduit.

17. The washing machine of claim 16, wherein the rib comprises:

a first protrusion that protrudes from the seating surface in the radial direction of the gasket; and a second protrusion that protrudes from the boundary surface toward the tub.

18. The washing machine of claim 17, wherein the rib further comprises a connecting protrusion that is disposed between the first protrusion and the second protrusion and that connects the first protrusion to the second protrusion.

19. The washing machine of claim 16, wherein the rib comprises a plurality of ribs spaced apart from each other and arranged along a circumferential direction of the gasket.

20. The washing machine of claim 16, wherein the gasket further comprises a plurality of port receiving pipes that protrude from the outer circumference of the gasket and that are configured to communicate with the plurality of nozzles, respectively, wherein the plurality of port receiving pipes comprise:

a lower port receiving pipe disposed vertically below than a horizontal line that passes through a center of the gasket; and an upper port receiving pipe disposed vertically above the horizontal line, and wherein the rib is disposed between the lower port receiving pipe and the upper port receiving pipe.

* * * * *